US008588635B2

(12) United States Patent
Ogawa et al.

(10) Patent No.: US 8,588,635 B2
(45) Date of Patent: Nov. 19, 2013

(54) DEVELOPMENT DEVICE, PROCESS CARTRIDGE INCORPORATING SAME, AND IMAGE FORMING APPARATUS INCORPORATING SAME

(75) Inventors: Yoshiko Ogawa, Tokyo (JP); Yasuyuki Ishii, Tokyo (JP); Hideki Kosugi, Kanagawa (JP); Masaaki Yamada, Tokyo (JP); Atsushi Kurokawa, Kanagawa (JP); Yuji Ishikura, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 334 days.

(21) Appl. No.: 12/980,951

(22) Filed: Dec. 29, 2010

(65) Prior Publication Data

US 2011/0164892 A1 Jul. 7, 2011

(30) Foreign Application Priority Data

Jan. 5, 2010 (JP) ..... 2010-000587
Jan. 6, 2010 (JP) ..... 2010-001175
Oct. 6, 2010 (JP) ..... 2010-226451
Oct. 8, 2010 (JP) ..... 2010-228343

(51) Int. Cl.
*G03G 15/02* (2006.01)

(52) U.S. Cl.
USPC ..... 399/55; 399/266

(58) Field of Classification Search
USPC ..... 399/38, 53–56, 107, 110, 111, 119, 399/120, 252, 265, 266, 290, 291
See application file for complete search history.

(56) References Cited

U.S. PATENT DOCUMENTS 7,526,238 B2 4/2009 Yamada et al.
7,783,235 B2 * 8/2010 Tsukamoto et al. ..... 399/260
8,073,350 B2 * 12/2011 Ishii et al. ..... 399/55
2008/0286015 A1 11/2008 Kadota et al.
2009/0022523 A1 1/2009 Kadota et al.
2009/0035025 A1 2/2009 Ishii et al.
2009/0257786 A1 10/2009 Nakagawa et al.
2010/0150615 A1 6/2010 Nakagawa et al.

FOREIGN PATENT DOCUMENTS

JP 2008-281953 11/2008
JP 2009-36929 2/2009

OTHER PUBLICATIONS

U.S. Appl. No. 12/879,390, filed Sep. 10, 2010, Horike et al.

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A development device includes a developer container, a rotary developer carrier that is disposed facing the latent image carrier and including multiple outer electrodes arranged in a circumferential direction of the developer carrier, an inner electrode electrically insulated from the multiple outer electrodes, an insulation layer disposed between the inner and outer electrodes, and a surface layer overlaying the outer electrodes and electrically insulating the multiple outer electrodes from each other, a bias power source to generate electrical fields that change with time by applying a first and second bias voltages to the inner and outer electrodes, respectively, an electrical field adjuster to regulate the electrical fields in accordance with a thickness of the surface layer of the developer carrier, and a controller.

21 Claims, 15 Drawing Sheets

DEVELOPMENT DEVICE, PROCESS CARTRIDGE INCORPORATING SAME, AND IMAGE FORMING APPARATUS INCORPORATING SAME

CROSS-REFERENCE TO RELATED APPLICATIONS

This patent specification is based on and claims priority from Japanese Patent Application Nos. 2010-000587, filed on Jan. 5, 2010, 2010-001175, filed on Jan. 6, 2010, 2010-226451 filed Oct. 6, 2010, and 2010-228343, filed on Oct. 8, 2010 in the Japan Patent Office, which are hereby incorporated by reference herein in their entirety.

BACKGROUND OF THE INVENTION

1. Field of the Invention

The present invention generally relates to a development device used in an image forming apparatus such as a copier, a printer, a facsimile machine, or a multifunction machine capable of at least two of these functions, a process cartridge incorporating the development device, and an image forming apparatus incorporating the development device.

2. Description of the Background Art

In general, electrophotographic image forming apparatuses, such as copiers, printers, facsimile machines, or multifunction devices including at least two of those functions, etc., include a latent image carrier on which an electrostatic latent image is formed and a development device to develop the latent image with developer with either one-component developer consisting essentially of only toner or two-component developer consisting essentially of toner and carrier.

For example, in development devices using one-component developer (i.e., toner), a developer carrier such as a development roller is disposed contactlessly with the latent image carrier, and the development device supplies the developer to the latent image formed on the latent image carrier by causing the developer to hop and form clouds (i.e., toner clouds) on or around the developer carrier. The developer carriers used in development devices using one-component developer typically include two layers of electrodes electrically insulated from each other, namely, an inner electrode and multiple outer electrodes positioned on an outer side of the developer carrier from the inner electrodes. The multiple outer electrodes are arranged at predetermined intervals (a predetermined pitch) in a circumferential direction of the developer carrier. The developer carrier further includes a surface layer overlaying an outer circumferential side of each outer electrode so as to protect the multiple outer electrodes while electrically insulating the multiple outer electrodes from each other.

In order to form toner clouds using such a developer carrier, the development device further includes a power source for applying separate voltages that change differently from each other with time to the inner electrode and the outer electrodes, respectively, thus generating electrical fields that change differently from each other with time between adjacent outer electrodes. The electrical fields cause the toner carried on the developer to hop between the adjacent outer electrodes and form toner clouds. It is to be noted that the phenomenon of the electrical fields being generated between the adjacent two of the multiple outer electrodes that causes toner to hop, thus forming toner clouds, is hereinafter referred to as "flare" or a "flare state". In other words, the term "flare" means a phenomenon in which toner hopping on a circumferential surface of the developer carrier forms toner clouds in an adjacent area of the circumferential surface of the developer carrier.

In this type of development device, if the electrical fields are extremely small, toner can neither hop on the developer carrier properly nor form toner clouds because the strength of the electrical fields is weaker than force of adhesion between the toner and the developer carrier. Accordingly, toner is not transferred to the latent image carrier from the developer carrier that is not in contact with the latent image carrier, resulting in a decrease in image density of output images. By contrast, if the electrical fields are extremely large, it is possible that voltage leaks between the inner electrode and each outer electrode, which can damage the electrodes themselves. Moreover, it is possible that voltage leaks between the outer electrodes and the surface layer of the developer carrier overlaying the outer electrodes, thus damaging the surface layer.

Therefore, the size or strength of the electrical fields is a critical factor and must be adjusted properly.

For example, JP-2009-36929-A discloses a development device that maintains a constant electrical potential on the surface of a flare roller, serving as the developer carrier, that includes an inner electrodes and multiple outer electrodes so as to prevent unevenness in the image density and scattering of toner in the backgrounds of output images. This known development device further includes a developer regulator, such as a doctor blade, that regulates the thickness of a toner layer formed on the flare roller and a voltage application device for applying a bias voltage to the developer regulator. The mean value of the bias applied to the developer regulator has an electrical potential identical to the mean value of the bias applied to the multiple outer electrodes of the flare roller.

Although effective for keeping the electrical potential on the surface of the flare roller constant, this known configuration is insufficient for keeping the flare state constant because only the bias voltage applied to the flare roller is considered in this known configuration. More specifically, the flare state also fluctuates due to deviations in the thickness of the surface layer (i.e., insulation layer or protection layer) of the flare roller, which is not considered in this known configuration. The thickness of the surface layer of the developer carrier varies originally due to manufacturing tolerances, and accordingly there are deviations in the proper electrical fields to be generated by the developer carrier. In other words, the electrical field for causing a desired flare state is unique to each developer carrier. Further, the surface layer of the developer carrier is abraded and becomes thinner over time by the contact with the developer regulator and the like, which causes the proper electrical fields for attaining the desired flare state to fluctuate as well.

In view of the foregoing, the inventors of the present invention recognize that there is a need for a development device capable of maintaining a constant flare state around the developer carrier, a process cartridge including the development device, and an image forming apparatus including the development device.

SUMMARY OF THE INVENTION

In view of the foregoing, in one illustrative embodiment of the present invention provides a development device that causes one-component developer to adhere to an electrostatic latent image formed on a latent image carrier and is capable of maintaining a constant level of image developability.

The development device includes a developer container for containing the developer, a rotary cylindrical developer carrier disposed in the developer container, facing and not in contact with the latent image carrier, a bias power source, an electrical field adjuster, and a controller operatively connected to the electrical field adjuster for controlling the electrical field adjuster. The developer carrier includes multiple outer electrodes arranged in a circumferential direction of the developer carrier, an inner electrode provided on an inner circumferential side of the developer carrier from the multiple outer electrodes and electrically insulated from the multiple outer electrodes, an insulation layer disposed between the multiple outer electrodes and the inner electrode, and a surface layer overlaying an outer side of each of the multiple outer electrodes and electrically insulating the multiple outer electrodes from each other. The bias power source applies a first bias voltage and a second bias voltage that change differently from each other with time to the inner electrode and the multiple outer electrodes, respectively, so as to generate electrical fields that change with time between the multiple outer electrodes, thus causing the developer to hop on the developer carrier. The electrical field adjuster keeps a state of the developer hopping on the developer carrier constant by regulating the electrical fields in accordance with a thickness of the surface layer of the developer carrier.

Another illustrative embodiment of the present invention provides a process cartridge removably installable in an image forming apparatus. The development device described above and at least one of the latent image carrier, a charge device, and a cleaning device are housed in a common casing.

Yet another illustrative embodiment of the present invention provides an image forming apparatus that includes a latent image carrier on which a latent image is formed and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
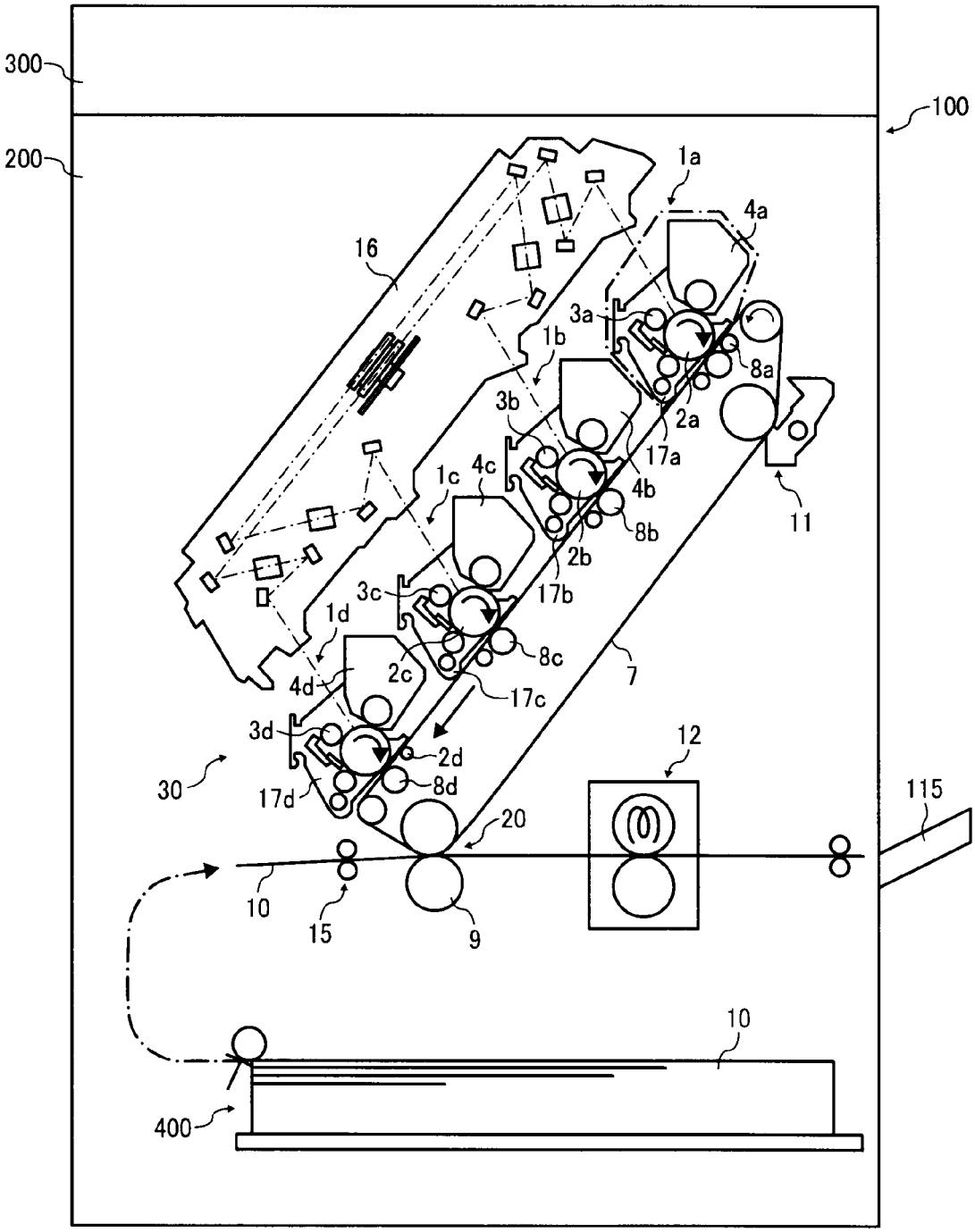
FIG. 1 is a schematic cross-sectional view of an image forming apparatus according to an illustrative embodiment, in which a development device is incorporated in a process cartridge.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to the present embodiment is described.

FIG. 1 is a cross-sectional diagram illustrating a configuration of the image forming apparatus according to the present embodiment.

An image forming apparatus 100 shown in FIG. 1 is a multicolor copier and has a configuration similar to known image forming apparatuses employing an electrophotographic method except development devices 4. It is to be noted that the configuration of the image forming apparatus 100 is not limited to that shown in FIG. 1, and features of the present embodiment can adapt to printers, facsimile machines, multifunction machines including at least two of these capabilities, or monochrome image forming apparatuses.

The image forming apparatus 100 shown in FIG. 1 includes a main body 200, a document reading unit 300 provided above the main body 200, and a sheet feeder 400 provided beneath the main body 200. The document reading unit 300 may be a known scanner that includes a reading surface for reading image data of original documents optically. The scanner may include an automatic document feeder (ADF) that feeds original documents automatically to the reading surface. Alternatively, the scanner does not include the ADF and users manually set original documents on the reading surface. Although not shown in the figures, the sheet feeder 400 includes a sheet tray and a feed roller, and has a known configuration to feed sheets 10 of recording media stacked on the sheet tray to an image transfer unit 20.

The main body 200 includes a tandem image forming unit 30 constituted of multiple image forming units each configured as process cartridges, provided above the sheet feeder 400. In the configuration shown in FIG. 1, the tandem image forming unit 30 includes four image forming units or process cartridges 1*a*, 1*b*, 1*c*, and 1*d*. The four process cartridges 1*a*, 1*b*, 1*c*, and 1*d* have a similar configuration except the color of toner used therein and form, for example, black, magenta, cyan, and yellow toner images, respectively.

It is to be noted that the suffixes a, b, c, and d attached to the reference numerals are only for color discrimination and hereinafter may be omitted when color discrimination is not necessary. Additionally, although the description below concerns a configuration in which the development device 4 is incorporated in the process cartridge 1, it is not necessary to house two or more of the components of the image forming unit 1 in a common unit casing as a process cartridge. Alternatively, features of the present embodiment can adapt to a configuration in which the development device 4 is installed in the image forming apparatus 100 independently.

Each of the four process cartridges 1 included in the tandem image forming unit 30 includes a photoconductor drum 2 serving as an image carrier, a charging member 3, the development device 4, and a cleaning unit 17, which are housed in a common unit casing and thus united. It is to be noted that features of the present embodiment can adapt not only to the process cartridge shown in FIGS. 1 and 2 but also to any process cartridge as long as it is removably installable in the image forming apparatus 100 and at least one of an image carrier, a charging member, and a cleaning unit is united with the development device 4 according to the present embodiment. In replacement, by operating a stopper, not shown, the used process cartridge 1 can be removed from the image forming apparatus 1, and a new one can be installed therein.

In the image forming apparatus 100 shown in FIG. 1, the process cartridges 1 are drawn out from the main body 200 upward from the surface of paper on which FIG. 1 is drawn when the front side of paper on which FIG. 1 is drawn is the front side of the image forming apparatus 100. That is, the process cartridges 1 are drawn out from the main body 200 from the back side to the front side of the apparatus. However, the direction of insertion and removal of the process cartridges 1 is not limited thereto. For example, depending on the type or internal configuration of the image forming apparatus, process cartridge can be inserted and removed in the lateral direction in FIG. 1 from the image forming apparatus.

Figure 2:
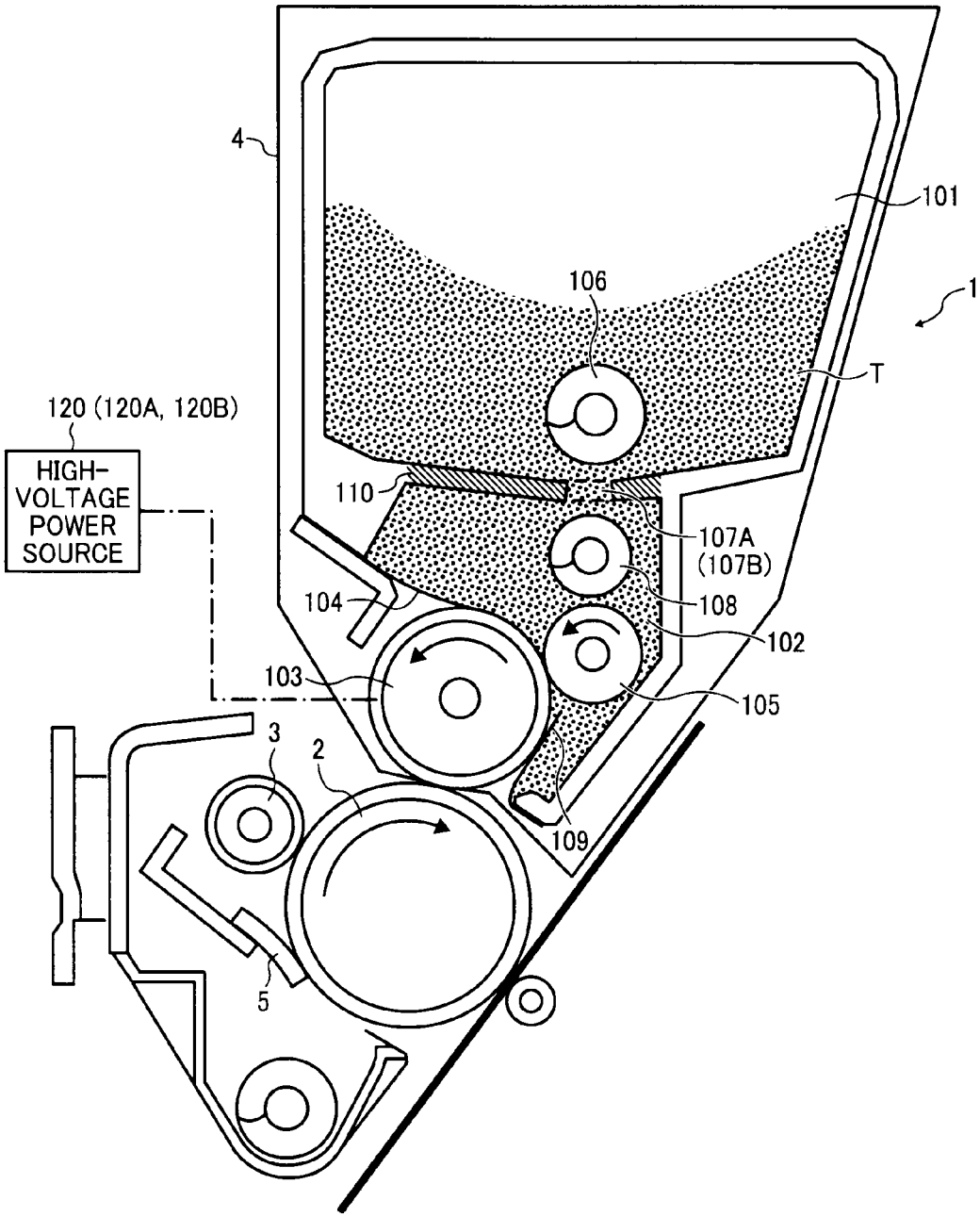
FIG. 2 is an end-on axial view of the process cartridge including the development device according to an illustrative embodiment.

The photoconductor drum 2 in each process cartridge 1 shown in FIG. 1 is rotatable clockwise in FIG. 1 as indicated by arrows. The charging member 3 is pressed against a surface of the photoconductor drum 2 and accordingly rotates as the photoconductor drum 2 rotates. A high-voltage power source (not shown) applies a predetermined bias voltage to each charging member 3 so that the charging member 3 can electrically charge the surface of the photoconductor drum 2 uniformly. It is to be noted that, although the charging members 3 shown in FIGS. 1 and 2 are contact-type roller-shaped charging members, contactless-type charging members such as those employing corona discharging may be used instead.

Additionally, an exposure unit 16 is provided obliquely above and parallel to the four process cartridges 1. The exposure unit 16 exposes each photoconductor drum 2 charged by the charging member 3 according to image data of each color read by the image reading unit 300, thus forming an electrostatic latent image on the photoconductor drum 2. Although a laser-beam scanning method employing laser diodes is used in the present embodiment, alternatively, light-emitting diode (LED) arrays may be used. The electrostatic latent image formed on the photoconductor drum 2 by the exposure unit 16 is developed with toner into a toner image when passing through the development device 4 as the photoconductor drum 2 rotates.

The image forming apparatus 100 further includes an intermediate transfer belt 7 that is disposed facing and in contact with the photoconductor drum 2 in each process cartridge 1. The intermediate transfer belt 7 is typically stretched around multiple support rollers, at least one of which serves as a driving roller, and rotates as the driving roller rotates. Additionally, primary-transfer rollers 8 are provided on a back side of the intermediate transfer belt 7 and positioned facing the respective photoconductor drums 2 via the intermediate transfer belt 7.

A high-voltage power source (not shown) applies a primary-transfer bias to each primary-transfer roller 8, and thus the toner image developed by the development device 4 is primarily transferred from the photoconductor drum 2 onto the intermediate transfer belt 7.

It is to be noted that any toner remaining on the photoconductor drum 2 after the primary image transfer is removed by the cleaning unit 17.

Next, image forming operation is described below.

It is to be noted that the image forming operations performed by the image forming units 1*a*, 1*b*, 1*c*, and 1*d* are similar except the color of toner.

Initially, the photoconductor drum 2 is rotated clockwise in FIG. 1 by a driving source, not shown, and simultaneously, a discharge unit, not shown, emits light to the photoconductor drum 2, thus initializing the electrical potential of the surface of the photoconductor drum 2. The surface of the photoconductor drum 2 thus discharged is then electrically charged by the charging member 3 uniformly to a predetermined polarity. Subsequently, the exposure unit 16 directs the laser beam to the charged surface of the photoconductor 2 according to the image read by the image reading unit 300, thus forming an electrostatic latent image thereon. More specifically, the exposure unit 16 directs the laser beam according to single color data, namely, yellow, cyan, magenta, or black data decomposed from the multicolor image data captured by the image reading unit 300 to the surface of the photoconductor 2. The electrostatic latent image thus formed on the photoconductor drum 2 is developed with toner into a toner image when passing through the development device 4.

The intermediate transfer belt 7 is rotated counterclockwise in FIG. 1, and a primary-transfer bias voltage having the polarity opposite the polarity of the toner image on the photoconductor drum 2 is applied to the primary-transfer roller 8. Thus, a transfer electrical field is generated between the photoconductor drum 2 and the intermediate transfer belt 7, and, in the primary image transfer, the toner image formed on the photoconductor drum 2 is electrically transferred onto the intermediate transfer belt 7 that rotates in synchronization with the photoconductor drum 2. The toner images are sequentially transferred from the respective photoconductor drums 2 from the upstream side in the direction in which the intermediate transfer belt 7 rotates, timed to coincide with rotation of the intermediate transfer belt 7, and superimposed one on another on the intermediate transfer belt 7, thus forming a desired multicolor image.

Meanwhile, the sheet 10 on which the image is to be formed is separated one at a time from the multiple sheets stacked in the sheet feeder 400 and fed to a pair of registration rollers 15 by a conveyance member such as a feed roller. Before the pair of registration rollers 15 starts rotating, a leading edge portion of the sheet 10 is caught in a nip between the registration rollers 15 pressing against each other, and thus registration of the sheet 10 is performed. Subsequently, timed to coincide with the multicolor toner image formed on the intermediate transfer belt 7, the pair of registration rollers 15 starts rotating, thus forwarding the sheet 10 to a secondary-image transfer portion 20 constituted of one of the support rollers around which the intermediate transfer belt 7 is stretched and a secondary-transfer roller 9 disposed facing the support roller via the intermediate transfer belt 7.

In the present embodiment, a transfer bias voltage whose polarity is opposite the polarity of the toner image formed on the intermediate transfer belt 7 is applied to the secondary-transfer roller 9, and thus the superimposed single-color toner images, together forming the multicolor image, are transferred from the intermediate transfer belt 7 onto the sheet 10 at one time. Then, the sheet 10 on which the toner image is formed is conveyed to a fixing device 12 including a fixing roller and a pressure roller according to a known configuration. While the sheet 10 passes through the fixing device 12, the toner image is fixed on the sheet 10 as a permanent image with heat and pressure from the fixing roller and the pressure roller. The sheet 10 on which the image is fixed is then discharged to a discharge tray 115. Thus, a sequence of image forming processes is completed. It is to be noted that any toner that is not transferred to the sheet 10 but remains on the intermediate transfer belt 7 is removed by a belt cleaning unit 11.

Next, the development devices 4 and the process cartridges 1 are described in further detail below with reference to FIG. 2.

FIG. 2 is an end-on axial view of the process cartridge 1 including the development device 4 according to the present embodiment. As described above, the four process cartridges 1 are provided in the tandem image forming unit 30 of the image forming apparatus 100.

The development device 4 shown in FIG. 2 includes a partition 110 that partially divides an interior of the development device 4 into a developer containing compartment 101 for containing developer T (hereinafter also "toner") and a supply compartment 102 positioned beneath the developer containing compartment 101, together forming a developer container. The development device 4 further includes a supply roller 105, a development roller 103 (a developer carrier), both provided in the supply compartment 102, a developer regulator 104 disposed facing the development roller 103, and a seal member 109 provided in contact with the development roller 103 to prevent leakage of developer from the development device 4. The development roller 103 is cylindrical in the present embodiment, and "cylindrical" used herein includes polygonal columner shapes.

At least one opening 107A and at least one opening 107B, arranged in the direction perpendicular to the surface of paper on which FIG. 2 is drawn, are formed in the partition 110. The opening 107A is for supplying the developer T from the developer containing compartment 101 to the supply compartment 102 (hereinafter also "supply opening 107A"), and the opening 107B is for returning excessive developer from the supply compartment 102 to the developer containing compartment 101 (hereinafter also "return opening 107B"). In other words, the developer T is conveyed from the developer containing compartment 101 to the supply compartment 102 through the supply opening 107A and conveyed from the supply compartment 102 to the developer containing compartment 101 through the return opening 107B, thus circulated in the development device 4.

Conveyance of developer in the development device 4 is described below.

Referring to FIG. 2, a developer conveyance member 106 is provided in the developer containing compartment 101. In the configuration shown in FIG. 2, the developer conveyance member 106 includes a rotary shaft, and a screw portion and a planar portion are attached to the rotary shaft. As the developer conveyance member 106 rotates, the developer T contained in the developer containing compartment 101 is transported substantially horizontally, which is perpendicular to the surface of paper on which FIG. 2 is drawn, with the effects of the screw portion and the planar portion.

It is to be noted that hereinafter "downstream" and "upstream" as used in this specification respectively mean downstream and upstream in the direction in which developer is transported (hereinafter "developer conveyance direction") in the development device 4 unless otherwise specified.

It is to be noted that the configuration of the developer conveyance member 106 is not limited to the description above, and alternatively, the developer conveyance member 106 may include a screw, a conveyance belt, or a coil-shaped rotary member for transporting developer. Yet alternatively, those can be combined with blade-like planar portions and/or paddles constructed of bent wire so that the developer conveyance member 106 can have additional capability to soften and break up coagulated developer. While transporting the developer T in an axial direction thereof, the developer conveyance member 106 supplies the developer T to the supply compartment 102 through the supply opening 107A.

In the supply compartment 102, a developer agitator 108 is provided beneath the openings 107A and 107B. Similarly, the developer agitator 108 includes a rotary shaft, and a screw portion and a planar portion are attached to the rotary shaft. Accordingly, the developer agitator 108 transports the developer T in the supply compartment 102 substantially horizontally, which is perpendicular to the surface of paper on which FIG. 2 is drawn, similarly to the developer conveyance member 106, although the direction is opposite the developer conveyance direction by the developer conveyance member 106. The developer agitator 108 further includes a reversed screw portion in which the direction of the spiral is reversed, provided in a downstream end portion thereof in the developer conveyance direction, so as to transport the developer in the direction opposite the direction in which the developer T is transported by an upstream portion of the developer agitator 108.

With this configuration, in the downstream end portion of the developer agitator 108, the excessive developer can be piled up from both sides in the developer conveyance direction and then brought up to the developer containing compartment 101. That is, a screw portion for transporting the developer T in the direction identical to the developer conveyance direction by the developer conveyance member 106 is provided in the downstream end portion of the developer agitator 108. Thus, the developer T contained in the developer containing compartment 101 is supplied to the supply compartment 102 through the supply opening 107A while transported by the developer conveyance member 106. Further, the excessive developer in the supply compartment 102 is piled in the downstream end portion of the developer agitator 108 and then is brought up to the developer containing compartment 101 through the return opening 107B separate from the supply opening 107A. As a result, the developer T is circulated between the developer containing compartment 101 and the supply compartment 107B.

The developer agitator 108 further has a capability to supply the developer T to the supply roller 105 positioned beneath the developer agitator 108 as well as the development roller 103 provided in contact with the supply roller 105 while agitating the developer T. A surface of the supply roller 105 is covered with a foamed material in which holes or cells are formed so that the developer T transported to the supply compartment 102 and then agitated by the developer agitator 108 can be efficiently attracted to the surface of the supply roller 105. Further, covering the surface of the supply roller 105 with the foamed material can alleviate the pressure in the portion where the supply roller 105 contacts the development roller 103, thus preventing or reducing deterioration of the developer T. It is to be noted that the electrical resistivity of the foamed material can be within a range from about $10^3\Omega$ to about $10^{14}\Omega$.

The supply roller 105 having the above-described configured rotates counterclockwise in FIG. 2 and supplies the developer carried on its surface to the surface of the development roller 103. At this time, a supply bias is applied to the supply roller 105 so as to facilitate supplying the preliminarily charged developer to the development roller 103 in the contact portion between the supply roller 105 and the development roller 103.

The developer regulator 104 adjusts the amount (i.e., layer thickness) of developer carried on the development roller 103, and, as the developer regulator 104, a metal spring including SUS 304CSP, SUS301SCP, or phosphor bronze may be used. One end of the developer regulator 104 is fixed, for example, to a casing of the development device 4, and the other end that is not fixed (i.e., a free end) is pressed against the surface of the development roller 103 with a pressure of, for example, about 10 N/m to 100 N/m. After the developer passes through the developer regulator 104, the layer thickness of the developer carried on the development roller 103 is adjusted and thickened, and the developer is electrically charged by friction with the developer regulator 104. Additionally, a bias is applied to the developer regulator 104 to facilitate the frictional charging.

The developer particles, that is, toner particles, supplied to the development roller 103 hop on the development roller 103 and form clouds (i.e., toner clouds) around the development roller 103. Further, as the development roller 103 rotates, the toner cloud is transported to the position (i.e., a development area) facing the photoconductor drum 2 disposed across a gap (i.e., development gap) from the development roller 103. Then, the toner cloud is attracted to the photoconductor drum 2 by the electrostatic field generated by the electrostatic latent image formed on the photoconductor drum 2, thus developing the latent image into a toner image.

It is to be noted that a high-voltage power source 120 including pulse power sources 120A and 120B (shown in FIG. 3) serves as a bias power source and applies a development bias voltage, and effects of the development bias voltage cause toner particles (developer) to move back and forth in the vicinity of the surface of the development roller 103, thus forming toner clouds, which is a phenomenon called "flare" and is described in detail later.

As the development roller 103 rotates, the developer T that is not supplied to the photoconductor drum 2 but remains on the development roller 103 is returned to the supply compartment 102 and is again supplied to the development area. The seal member 109 is provided in a portion where the developer T is returned from the development roller 103 to the supply compartment 102, and a bias is applied to the seal member 109 for removing electricity from the developer T. The gap between the development roller 103 and the casing of the development device 4 is sealed with the seal member 109 to prevent leakage of developer. It is to be noted that, for example, the developer, that is, toner, used in the present embodiment can be manufactured through polymerization and have a mean particle diameter of about 6.5 μm, a circularity of about 0.98, and an angle of rest of about 33°. Additionally, strontium titanate can be added to the developer as an external additive.

Descriptions are given below of mechanism of formation of toner clouds and generation of flares together with a configuration of the development roller 103 with reference to FIG. 3.

Figure 3:
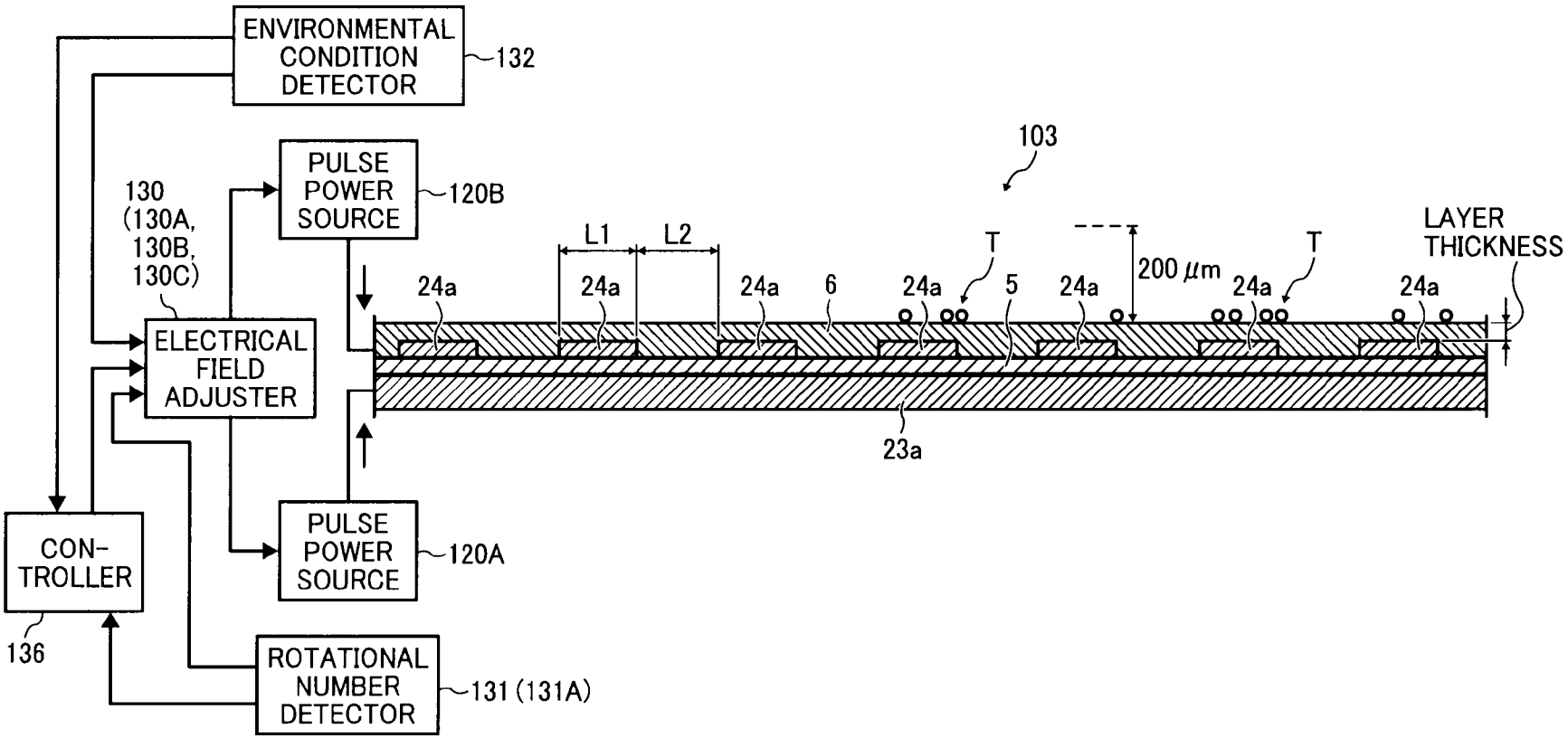
FIG. 3 is a partial cross-sectional view of layers of electrodes, namely, an inner electrode and multiple outer electrodes of a cylindrical development roller in a direction perpendicular to an axial direction thereof in a state as if the cylindrical development roller is unrolled into a planar structure.

FIG. 3 is a partial cross-sectional view that illustrates layers of electrodes of the cylindrical development roller 103 in a direction perpendicular to an axial direction thereof when the development roller 103 is flattened.

The development roller 103 in the present embodiment is formed with a hollow cylinder and includes an inner electrode 23*a* as an innermost layer. Inside the inner electrode 23*a* is a hollow 25 formed in the development roller 103 as shown in FIG. 4B. The development roller 103 further includes multiple outer electrodes 24*a* positioned on the outer side of the inner electrode 23*a* and not in contact with the inner electrode 23*a*. The multiple outer electrodes 24*a* are arranged in parallel to each other in a short side direction, that is, a circumferential direction, of the development roller 103. A first voltage (i.e., an inner voltage) and a second voltage (i.e., an outer voltage) that change with time differently from each other are applied to the inner electrode 23*a* and the outer electrodes 24*a*, respectively. Thus, the development roller 103 includes two layers of electrodes. The pulse power sources 120A and 120B, together forming the high-voltage power source 120, are connected to the inner electrode 23*a* and the outer electrodes 24*a*, respectively. An electrical field adjuster 130 is connected to the pulse power sources 120A and 120B. Further, a first rotational number detector 131 (or a second rotational number detector 131A) and an environmental condition detector 132, to be described later, are connected to the electrical field adjuster 130.

The development roller 103 further includes an electrical insulation layer 5 provided between the outer electrodes 24*a* and the inner electrode 23*a* to electrically insulate these electrodes from each other and a surface layer 6 serving as a protective layer overlying the outer circumferential surfaces of the outer electrodes 24*a*. The surface layer 6 also serves as an electrical insulation layer to electrically insulate the outer electrodes 24*a* from each other.

It is to be noted that, in FIG. 3, reference characters L1 represents a width, that is, a length in the circumferential direction of the development roller 103, of each outer electrode 24*a*, and L2 represents the interval between or pitch of the outer electrodes 24*a* in the circumferential direction of the development roller 103.

Figure 4A:
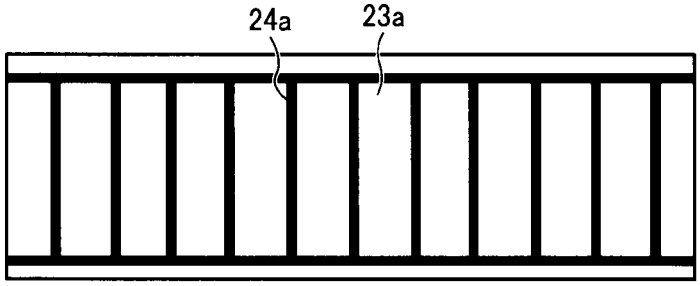
FIG. 4A is a schematic developed view in which the development roller is developed into a planar structure.
Figure 4B:
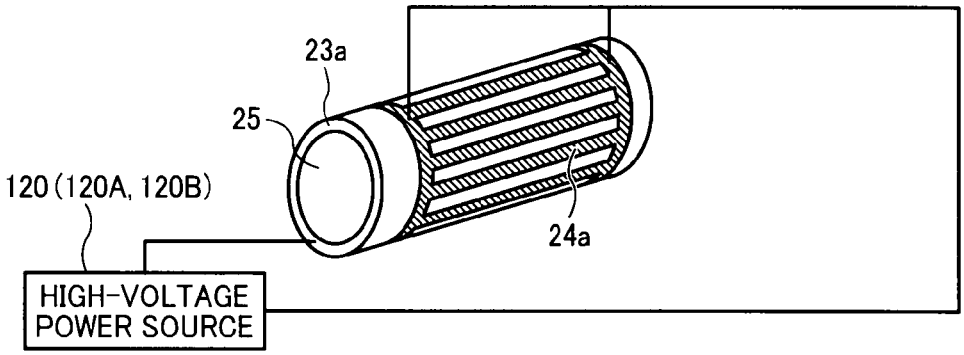
FIG. 4B is a schematic perspective view of the development roller.

FIGS. 4A and 4B illustrate arrangement of the electrodes of the development roller 103. FIG. 4A is a schematic developed view in which the development roller 103 is developed into a planar structure, and FIG. 4B is a schematic perspective view of the development roller 103. The outer electrodes 24*a* may be arranged like a comb or ladder, and, as shown in FIG. 4A, the outer electrodes 24*a* are arranged like a ladder in the present embodiment. It is to be noted that the insulation layer 5 and the surface layer 6 are not illustrated in FIGS. 4A and 4B for simplicity.

Thus, the development roller 103 has a four-layered structure including the inner electrode 23*a*, the insulation layer 5, the outer electrodes 24*a*, and the surface layer 6 also serving as another insulation layer in that order from inside, that is, the side of the hollow.

Herein, the inner electrode 23*a* also serves as a base of the development roller 103 and can be a cylindrical metal roller formed of an electroconductive material. The electrode 23*a* can include SUS (Steel Use Stainless), aluminum, or the like. The inner electrode 23*a* can be manufactured by forming an electroconductive metal layer of, for example, aluminum or copper on a surface of a resin roller. Examples of the material of the resin roller include polyacetal (POM) or polycarbonate (PC). The electroconductive layer can be manufactured through metal plating or vapor deposition. Alternatively, the metal layer may be bonded to the surface of the resin roller.

The outer circumferential side of the inner electrode 23*a* is covered with the insulation layer 5. The insulation layer 5 can be formed of polycarbonate, alkyd melamine, or the like. The thickness of the insulation layer 5 is preferably within a range of from 3 μm to 50 μm. If the thickness of the insulation layer 5 is thinner than 3 μm, insulation between the inner electrode 23*a* and the outer electrodes 24*a* might become insufficient, thus increasing the possibility of leakage of electricity between the inner electrode 23*a* and the outer electrodes 24*a*. By contrast, if the thickness of the insulation layer 5 is greater than 50 μm, generation of the electrical field to be formed outside the surface layer 6 is inhibited. As a result, it becomes difficult to form a sufficiently strong electrical field outside the surface layer 6. In the present embodiment, the insulation layer 5 is formed of melamine resin and has a thickness of 20 μm. Through a spraying method or dipping method, the insulating layer 5 having a uniform thickness can be formed on the inner electrode 23*a*.

Outside the insulation layer 5, the multiple outer electrodes 24*a* formed of metal are formed. The outer electrodes 24*a* can include aluminum, copper, silver, or the like. There are various methods to form the multiple outer electrodes 24*a* arranged at predetermined intervals into a comb-like or ladder-like shape. For example, a uniform metal layer can be formed on the insulation layer 5 through plating or vapor deposition, after which the metal layer can be etched by photoresist etching. Alternatively, electrodes arranged in a comb ladder shape may be formed by causing an electroconductive paste to adhere to the insulation layer 5 through ink ejection or screen printing.

The outer layer 6 overlays both the outer circumferential faces of the outer electrodes 24*a* arranged in a comb-like or ladder-like shape and the outer circumferential faces of the exposed portions of the insulation layer 5 present between the outer electrodes 24*a*. While hopping repeatedly on the outer layer 6, the developer is electrically charged by frictional contact with the outer layer 6. Therefore, in the present embodiment, it is preferable that silicone, nylon (registered trademark), urethane, alkyd melamine, polycarbonate, or the like be used as the material of the outer layer 6 so that the developer can have a proper electrical charge polarity (negative in the present embodiment). In the present embodiment, polycarbonate is used. Additionally, it is preferred that the surface layer 6 has a layer thickness within a range of from about 3 μm to 40 μm since the surface layer 6 also serves as the protection layer.

It is to be noted that the term "layer thickness" used herein means the length from the outer circumferential side of the outer electrodes 24*a* to the outer circumferential surface of the development roller 103 as shown in FIG. 3. If the surface layer 6 is thinner than 3 μm, it is possible that the surface layer 6 is abraded over time and the outer electrodes 24*a* are exposed. By contrast, if the surface layer 6 is thicker than 40 μm, it might be difficult to generate electrical field outside the surface layer 6 with the effects of the inner electrode 23*a* and the outer electrodes 24*a*. Accordingly, it can become difficult to form a sufficiently strong electrical field for causing flare of toner (hereinafter "electrical field for flare") outside the surface layer 6. In the present embodiment, the thickness of the surface layer 6 is about 20 μm, for example. The surface layer 6 can be produced by a splaying or dipping method similarly to the insulation layer 5.

In the present embodiment, in the development roller 103 configured as described above, the electrical fields that change with time are formed between the outer electrodes 24*a* by applying voltages that change differently from each other with time to the inner electrode 23*a* and the outer electrodes 24*a*. More specifically, the electrical fields are formed between the portions where the outer electrode 24*a* are provided (tooth portions of the comb shape) and the portions where the outer electrodes 24*a* are not provided, that is, where the inner electrode 23*a* does not face the outer electrode 24*a*. The electrical fields thus generated extend outside the surface layer 6, and effects of the electrical fields that change with time cause the developer to form clouds on the development roller 103 and further cause flare of toner. In other words, in the present embodiment, the electrical fields sufficiently strong for the developer supplied to the development roller 103 to hop on the development roller 103 are formed between the outer electrodes 24*a* by the effects of the inner electrode 23*a* and the outer electrodes 24*a* so as to cause the developer to form clouds, thus causing a flare state.

At that time, the developer on the development roller 103 flies reciprocally back and forth while hopping between the tooth portions where the outer electrodes 24*a* are present and the portions where the outer electrodes 24*a* are not present. With the above-described configuration and specifications of the insulation layer 5 and the surface layer 6, the inner electrode 23*a* can be insulated from the outer electrodes 24*a* reliably and effectively, and accordingly leakage of electricity can be eliminated or reduced effectively even when a relatively high voltage is applied to the development roller 103.

Additionally, the width L1, that is, the length in the circumferential direction of the development roller 103, of each outer electrode 24*a* is preferably within a range of from about 10 μm to 120 μm. If the width L1 of the outer electrodes 24*a* is as thin as 10 μm or less, the outer electrodes 24*a* might break. By contrast, if the width L1 of the outer electrodes 24*a* is as wide as 120 μm or greater, because the pulse power sources 120A and 120B (power supply units) are connected to end portions of the development device 103 in the axial direction thereof as shown in FIG. 4B, the voltage supplied to the outer electrodes 24*a* becomes lower in a center portion farther from the power supply units. As a result, it becomes difficult to form stable toner clouds in that portion effectively.

Further, the pitch L2 of the outer electrodes 24*a* is preferably equal to or greater than the width L1 of the outer electrodes 24*a*. If the pitch L2 is smaller than the width L1 of the outer electrodes 24*a*, it is possible that many of the lines of electrical force generated by the inner electrode 23*a* converge in the outer electrodes 24*a* before extending outside the surface layer 6, and thus the electrical field generated outside the surface layer 6 becomes weaker. However, if the pitch L2 of the outer electrodes 24*a* is extremely large, the electrical field might weaker in the center portion in the axial direction of the development roller 103. Therefore, in the present embodiment, it is preferable that the pitch L2 of the outer electrodes 24*a* be greater than the width L1 thereof and equal to or less than five times the width L1. For example, the width L1 and the pitch L2 of the outer electrodes 24*a* are 80 μm in the present embodiment.

It is to be noted that it is preferred that the pitch L2 of the outer electrodes 24*a* be constant in the circumferential direction of the development roller 103. When the pitch L2 of the outer electrodes 24*a* is constant in the circumferential direction of the development roller 103, the electrical fields generated between the inner electrode 23*a* and the outer electrodes 24*a* can be uniform in the circumferential direction. Accordingly, the flare state in the development area can be uniform in the circumferential direction, thus facilitating uniform image development.

Next, the bias voltages applied to the inner electrode 23*a* and the outer electrodes 24*a* to generate the electrical fields are described below.

As shown in FIG. 3, the pulse power sources 120A and 120B, together forming the high-voltage power source 120, are connected to the inner electrode 23*a* and the outer electrodes 24*a*, respectively. The pulse power sources 120A and 120B respectively apply a first bias voltage or inner bias voltage and a second bias voltage or outer bias voltage to the inner electrode 23*a* and the outer electrodes 24*a*. As the waveform of the inner bias voltage and the outer bias voltage supplied by the pulse poser sources 120A and 120B, rectangular waves are more suitable. However, the inner bias voltage and the outer bias voltage supplied by the pulse poser sources 120A and 120B may be triangular waves such as those having sine curves. Additionally, in the present embodiment, the inner electrode 23*a* and the outer electrodes 24*a* are for causing flare, and voltages whose phases are different are applied to the inner electrode 23*a* and the outer electrodes 24*a*. In other words, the electrodes for generating the electrical fields for flare have a biphasic configuration.

Figure 5:
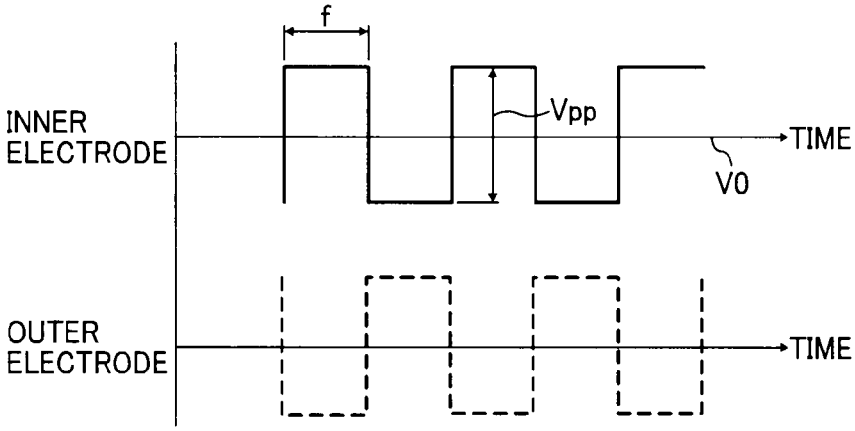
FIG. 5 illustrates a waveform of an inner bias voltage applied to the inner electrode and that of an outer bias voltage applied to the outer electrodes whose phases are shifted a half cycle (180 degrees or it) from each other.

FIG. 5 illustrates the inner bias voltage and the outer bias voltage respectively applied to the inner electrode 23*a* and the outer electrodes 24*a* as examples.

Referring to FIG. 5, the waveform of the inner bias voltage and the outer bias voltage are rectangular. For ease of understanding, the inner bias voltage and the outer bias voltage shown in FIG. 5 have an identical peak-to-peak voltage (Vpp), and their phases are shifted a half cycle (180 degrees or π) from each other. In the state shown in FIG. 5, the difference in electrical potential between the inner bias voltage and the outer bias voltage equals to the peak-to-peak voltage Vpp constantly. This potential difference generates the electrical fields that change with time between the electrodes, and the developer on the surface layer 6 of the development roller 103 is caused to hop and to form toner clouds by the electrical field for flare generated outside the surface layer 6 among these electrical fields.

It is to be noted that, a center value V0 of the inner bias voltage and the outer bias voltage is within a range from the electrical potential of image portions where electrostatic latent images are present to the electrical potential of non-image portion, that is, the backgrounds of the images. The center value V0 may be adjusted as required according to development conditions. Alternatively, similar effects can be attained by setting the center value V0 to a fixed value and changing the duty ratio instead.

Additionally, it is preferred that the frequency f of the inner bias voltage and the outer bias voltage be within a range from about 0.1 kHz to 10 kHz. If the frequency f is lower than 0.1 kHz, the velocity at which the developer hops might be slower than the velocity of image development. If the frequency f is higher than 10 kHz, the developer might fail to move in conformity with switching of the electrical field, and it becomes difficult to cause the developer to hop reliably. In the present embodiment, the frequency f of the inner bias voltage and the outer bias voltage is 500 Hz, for example.

In image development using the above-described development roller 103 as the developer carrier, it is known that, because the surface of the development roller 103 is in contact with the seal member 109 for electrical discharge in addition to the developer regulator 104 and the supply roller 105, the surface of the development roller 103 is abraded over time, and accordingly the layer thickness of the surface layer 6, which is the distance between the outer side of the outer electrodes 24*a* to the outer circumferential surface of the development roller 103, becomes uneven. Naturally, changes in the thickness of the surface layer 6 of the development roller 103 affect the electrical field for flare.

Figure 6:
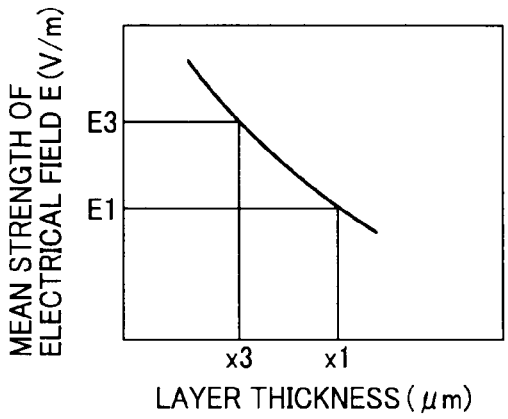
FIG. 6 is a graph illustrating changes in a mean strength of electrical fields generated on the development roller due to changes in the thickness of a surface layer of the development roller.

FIG. 6 is a graph illustrating changes in a mean strength of the electrical field on the development roller 103 due to changes in the thickness of the surface layer 6 of the development roller 103.

As can be seen from FIG. 6, the strength of the electrical field for flare varies in accordance with changes in the thickness of the surface layer 6 of the development roller 103. It is to be noted that the mean strength of the electrical field shown in FIG. 6 was measured 200 μm above the surface of the development roller 103 (see FIG. 3). It is preferable that the measurement position, that is, the vertical distance from the surface of the development roller 103, be decided in consideration of the desired development gap and the like. Referring to FIG. 6, for example, if it is assumed that the mean strength of the electrical field is E1 in an initial state in which the layer thickness is x1 (i.e., initial thickness), the mean strength of the electrical field increases to E3 when the layer thickness is reduced to x3 from x1 over time. If the electrical field for flare is affected by changes in the layer thickness of the surface layer 6, the state and amount of toner forming toner clouds are also affected. Consequently, developability fluctuates, thus making image density of images to be printed uneven.

Therefore, in the various embodiments of the present embodiment described below, the electrical field adjuster 130 shown in FIG. 3 is provided for regulating the strength of the electrical field in accordance the thickness of the surface layer 6 by adjusting at least one of various development-related variables. The electrical field adjuster 130 maintains a constant flare state of developer on the development roller 103 by adjusting the strength of the electrical field, thus keeping the developability of the development roller 103 constant.

Next, electrical field adjusters according to various embodiments are described below.

In a first embodiment, the electrical field adjuster 130 includes a voltage adjuster that adjusts, as the development-related variable, the peak-to-peak voltage Vpp of the first and second bias voltages respectively applied to the inner electrode 23*a* and the outer electrodes 24*a* by the pulse power sources 120A and 120B (hereinafter also "voltage adjuster 130"). When the peak-to-peak voltage Vpp of the first and second bias voltages is changed, the strength of the electrical field for flare is changed accordingly. As a result, the flare state varies. This phenomenon is described in further detail with reference to FIG. 7.

Figure 7:
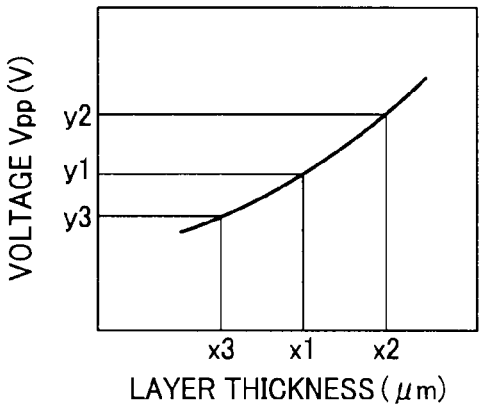
FIG. 7 is a graph illustrating the relation between the thickness of the surface layer and a peak-to-peak voltage of the bias voltages to maintain a constant, desired level of developability.

FIG. 7 is a graph illustrating the relation between the thickness of the surface layer 6 and the peak-to-peak voltage Vpp when a constant, desired level of developability is maintained.

As shown in FIG. 7, when the thickness of the surface layer 6 is x1, the suitable peak-to-peak voltage Vpp of the bias voltages for attaining the desired flare state is y1. Similarly, when the thickness of the surface layer 6 is x2 and x3, the suitable peak-to-peak voltage Vpp is y2 and y3, respectively. This relation can be expressed as formula 1 shown below.

$$Vpp=f_E(t_x) \quad (1)$$

wherein $t_x$ represents the thickness of the surface layer 6 of the development roller 103.

The relation shown in FIG. 7 and expressed as formula 1 can be experimentally obtained. More specifically, the thickness of the surface layer 6 is gradually reduced from the initial thickness, and the amount by which the peak-to-peak voltage Vpp of the bias voltages should be adjusted (hereinafter "adjustment amount") for maintaining a constant flare state, that is, a constant level of developability, is determined for each thickness. By obtaining the relation shown in FIG. 7 and expressed as formula 1, the adjustment amount of the peak-to-peak voltage Vpp can be calculated when the thickness of the surface layer 6 is varied. That is, a suitable value of the peak-to-peak voltage Vpp (development-related variable) for the current thickness of the surface layer 6 can be obtained. Accordingly, the flare state can be kept constant in accordance with changes in the thickness of the surface layer 6.

For example, when the thickness of the surface layer 6 is reduced from the initial thickness of x1 to x3 over time, the strength of the electrical field for flare increases. At that time, a flare state similar to the initial state can be attained by reducing the peak-to-peak voltage Vpp of the bias voltages to y3.

This adjustment is also effective to handle deviations in the thickness of the surface layer of development rollers due to tolerance in manufacturing. For example, it is assumed that the thickness x1 is a standard thickness of the surface layer of development rollers. In this case, if the thickness of the surface layer of a given development roller is x2, the desired flare state can be attained by setting the peak-to-peak voltage Vpp of the bias voltages to y2 initially. Thus, deviations in the thickness of the surface layer unique to specific development rollers can be managed.

A second embodiment is described below.

An electrical field adjuster 130A according to the second embodiment adjusts the flare state of developer by adjusting, as another development-related variable, a rise time ms of the bias voltages applied to the inner electrode 23*a* and the outer electrodes 24*a* of the development roller 103. In other words, the electrical field adjuster 130A according to the second embodiment includes a rise time adjuster for adjusting the rise time ms of the bias voltages applied by the pulse power sources 120A and 120B (hereinafter also "rise-time adjuster 130A"). The strength of the electrical field for flare can be regulated by adjusting the rise time ms of the bias voltages as well when the peak-to-peak voltage Vpp of the bias voltages is kept constant. This phenomenon is described in further detail with reference to FIG. 8.

Figure 8:
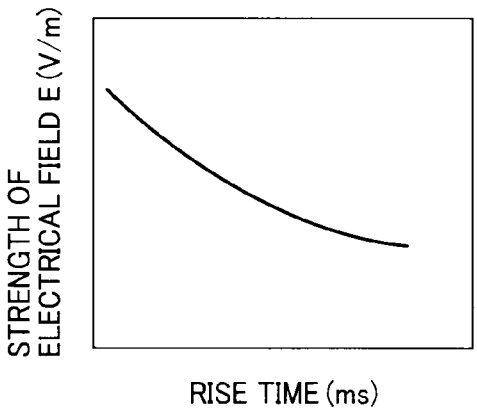
FIG. 8 is a graph that illustrates the relation between a rise time of the bias voltages applied to the inner electrode and the outer electrodes and the mean strength of the electrical fields on the surface of the development roller.

FIG. 8 is a graph that illustrates the relation between the rise time ms of the bias voltages applied to the inner electrode 23*a* and the outer electrodes 24*a* and the mean strength of the electrical fields on the surface of the development roller 103.

As can be seen from FIG. 8, even when the bias voltages applied to the inner electrode 23*a* and the outer electrodes 24*a* are constant, the mean strength of the electrical fields on the surface of the development roller 103 can be varied by changing the rise time ms of the bias voltages. Therefore, adjusting the rise time ms of the bias voltages can regulate the strength of the electrical fields and accordingly can regulate the flare state. It is to be noted that, in the present embodiment, the peak-to-peak voltage Vpp of the bias voltages is 300 Hz although it is 500 Hz in the previous embodiment.

Figure 9:
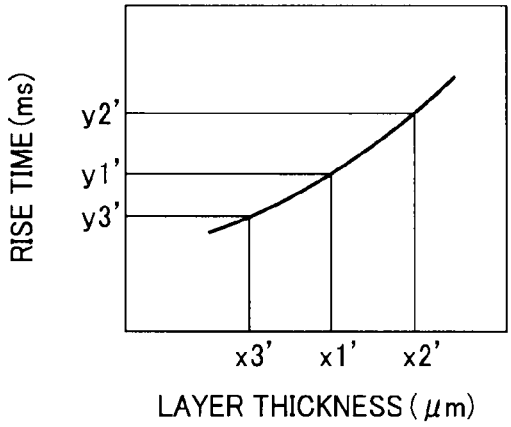
FIG. 9 is a graph illustrating the relation between the thickness of the surface layer and the rise time of the bias voltages to maintain a constant, desired level of developability.

FIG. 9 is a graph that illustrates the relation between the thickness of the surface layer of the development roller and the rise time ms of the bias voltages based on the relation shown in FIG. 8 when the strength of the electrical field, that is, the developability, is kept constant at a desired level.

As shown in FIG. 9, when the thickness of the surface layer 6 is x1', the rise time ms of the bias voltages for attaining the desired flare state is y1'. Similarly, when the thickness of the surface layer 6 is x2' and x3', the rise time of the bias voltages is y2' and y3', respectively. This relation can be expressed as formula 2 shown below.

$$ms=f_E(t_x) \quad (2)$$

wherein $t_x$ represents the thickness of the surface layer 6 of the development roller 103.

The relation shown in FIG. 9 and expressed as formula 2 can be experimentally obtained. More specifically, the thickness of the surface layer 6 is gradually reduced from the initial thickness, and the duration of time by which the rise time ms of the bias voltages should be adjusted (hereinafter "adjustment amount") for maintaining a constant flare state, that is, a constant level of developability, is determined for each thickness. By obtaining the relation shown in FIG. 9 and expressed as formula 2, the adjustment amount of the rise time ms of the bias voltages can be calculated when the thickness of the surface layer 6 is varied, and a suitable value of the rise time (development-related variable) for the current thickness of the surface layer 6 can be obtained. Accordingly, the flare state can be kept constant in accordance with changes in the thickness of the surface layer 6.

For example, when the thickness of the surface layer 6 is reduced from the initial thickness of x1' to x3' over time, the strength of the electrical field for flare increases. At that time, a flare state similar to the initial state can be attained by reducing the rise time ms of the bias voltages to y3'.

This adjustment is also effective to handle differences in the thickness of the surface layer 6 of the development roller 103 due to tolerance in manufacturing. For example, it is assumed that the thickness x1' is a standard thickness of the surface layer of development rollers. In this case, if the thickness of the surface layer of a given development roller is x2', the desired flare state can be attained by setting the rise time ms of the bias voltages to y2' initially. Thus, deviations in the thickness of the surface layer unique to specific development rollers can be managed.

A third embodiment is described below.

An electrical field adjuster 130B according to the third embodiment includes a frequency adjuster that adjusts, as yet another development-related variable, the frequency of the first and second bias voltages respectively applied to the inner electrode 23*a* and the outer electrodes 24*a* by the pulse power sources 120A and 120B (hereinafter also "frequency adjuster 130B"). When the frequency of the bias voltages for generating the electrical field that changes with time is changed so as to change the state of the electrical field for flare, the number of times the developer hops on the development roller 103 during a unit time changes. Consequently, the state of developer that forms toner clouds changes, and accordingly the level of developability changes as well. This phenomenon is described in further detail with reference to FIG. 10.

Figure 10:
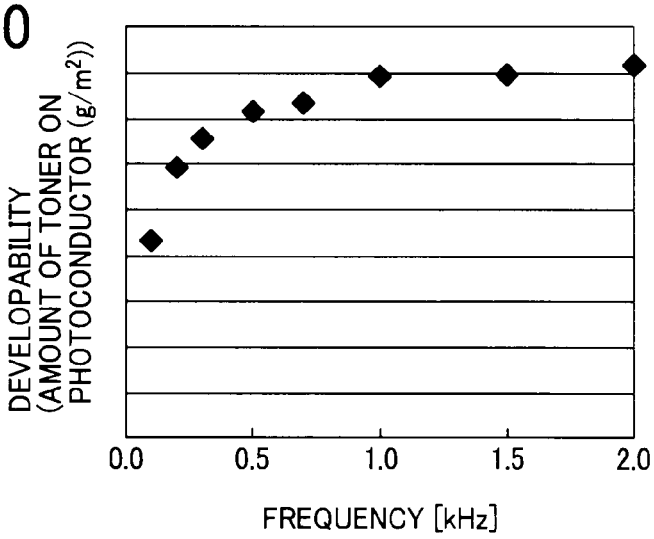
FIG. 10 is a graph illustrating the relation between developability and the frequency of the bias voltages applied to the inner and outer electrodes, respectively.

FIG. 10 is a graph that illustrates the relation between the frequency of bias voltages and developability.

As can be seen from FIG. 10, increasing the frequency of the bias voltages increases the number of times the developer hops, and accordingly formation of toner clouds is facilitated. Thus, the level of developability is increased. By contrast, decreasing the frequency of the bias voltages decreases the number of times the developer hops, and accordingly formation of toner clouds is inhibited. Thus, the level of developability is lowered.

Therefore, when the electrical field for flare is regulated by adjusting the frequency of the bias voltages, the state of developer that forms toner clouds, that is, the flare state, can be adjusted. Thus, the developability can be regulated.

Based on the relation shown in FIG. 10, for example, even when the mean strength of the electrical field increases and accordingly the level of developability is increased due to decreases in the thickness of the surface layer 6 of the development roller 103, the flare state can be restricted by decreasing the frequency of the bias voltages applied to the inner electrode 23*a* and the outer electrodes 24*a*. Consequently, the level of developability can be regulated.

Figure 11:
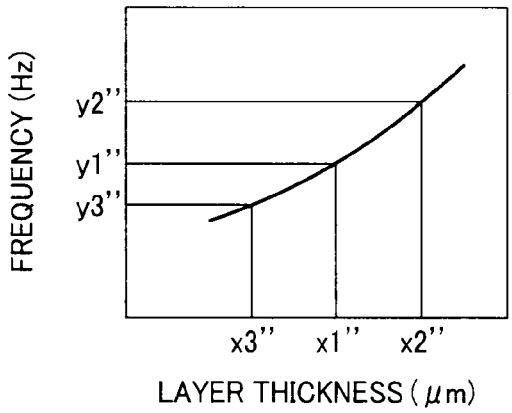
FIG. 11 is a graph that illustrates the relation between the thickness of the surface layer and the frequency of the bias voltage to maintain a constant, desired level of developability.

FIG. 11 is a graph that illustrates the relation between the thickness of the surface layer 6 and the frequency $f_{Hz}$ when the developability is kept constant at a desired level.

As shown in FIG. 11, when the thickness of the surface layer 6 is x1", the frequency $f_{Hz}$ of the bias voltages for attaining the desired flare state is y1". Similarly, when the thickness of the surface layer 6 is x2" and x3", the frequency f of the bias voltages is y2" and y3", respectively. This relation can be expressed as formula 3 shown below.

$$f_{Hz}=f_E(t_x) \tag{3}$$

wherein $t_x$ represents the thickness of the surface layer 6 of the development roller 103.

The relation shown in FIG. 11 and expressed as formula 3 can be experimentally obtained. More specifically, the thickness of the surface layer 6 is gradually reduced from the initial thickness, and the amount by which the frequency of the bias voltages should be adjusted (hereinafter "adjustment amount") for maintaining a constant flare state, that is, a constant level of developability, is determined for each thickness. By obtaining the relation shown in FIG. 11 and expressed as formula 3, the adjustment amount of the frequency $f_{Hz}$ of the bias voltages can be calculated when the thickness of the surface layer 6 is varied, and a suitable value of the frequency $f_{Hz}$ (development-related variable) for the current thickness of the surface layer 6 can be obtained. Accordingly, the flare state can be kept constant in accordance with changes in the thickness of the surface layer 6. For example, when the thickness of the surface layer 6 is reduced from the initial thickness of x1" to x3" over time, the strength of the electrical field for flare increases. At that time, a flare state similar to the initial state can be attained by reducing the frequency f of the bias voltages to y3".

This adjustment is also effective to handle differences in the thickness of the surface layer 6 of the development roller 103 due to tolerance in manufacturing. For example, it is assumed that the thickness x1" is a standard thickness of the surface layer of development rollers. In this case, if the thickness of the surface layer of a given development roller is x2", the desired flare state can be attained by setting the frequency $f_{Hz}$ of the bias voltages to y2" initially. Thus, deviations in the thickness of the surface layer unique to specific development rollers can be managed.

A fourth embodiment is described below.

An electrical field adjuster 130C according to the third embodiment includes a phase adjuster that adjusts, as yet another development related-variable, differences in phase between the first and second bias voltages respectively applied to the inner electrode 23*a* and the outer electrodes 24*a* (hereinafter also "phase adjuster 130C").

Figure 12:
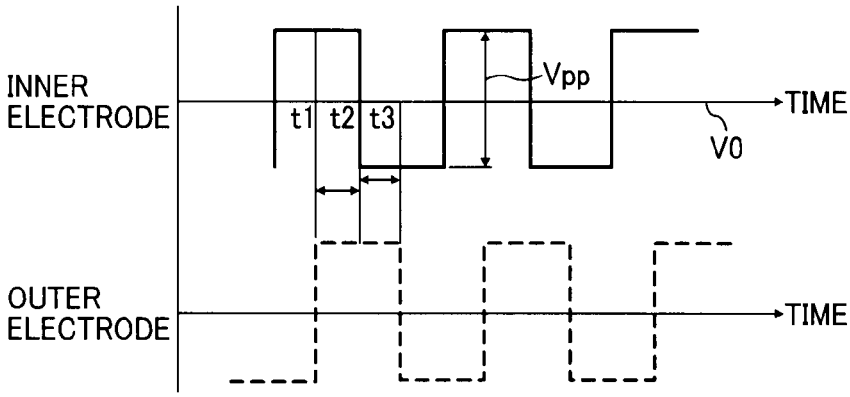
FIG. 12 illustrates a waveform of an inner bias voltage applied to the inner electrode and that of an outer bias voltage applied to the outer electrodes whose phases are shifted $\frac{1}{2}\pi$ from each other.

The theory of adjusting the flare state on the development roller 103 by adjusting differences in phase between the first and second bias voltages respectively applied to the inner electrode 23*a* and the outer electrodes 24*a* is described below by comparing FIGS. 5 and 12. FIG. 12 illustrates the inner bias voltage and the outer bias voltage having rectangular waveforms and an identical peak-to-peak voltage (Vpp), and their phases are shifted ½π from each other differently from those shown in FIG. 5.

Although the inner bias voltage and the outer bias voltage are constantly different by a voltage equal to the peak-to-peak voltage Vpp in the case shown in FIG. 5, in the case shown in FIG. 12 in which phases are shifted ½π from each other, during a period from a time t1 to a time t2, the potential of the inner electrode 23*a* is identical or similar to that of the outer electrode 24*a* and thus the electrical field for flare is not generated. By contrast, during a period from the time t2 to a time t3, the inner bias voltage and the outer bias voltage are different by a voltage equal to the peak-to-peak voltage Vpp, that is, the bias voltage is applied between the inner electrode 23*a* and the outer electrode 24*a*, and thus generating the electrical field for flare. In other words, there are no electrical fields for flare that cause the developer to hop during the period from the time t1 to the time t2, and the electrical fields for flare that cause the developer to hop are generated only during the period from the time t2 to the time t3. Therefore, the duration of time during which the developer hops and forms toner clouds is changed (reduced in this case), and the flare state is changed accordingly. Consequently, the level of developability is reduced in the case shown in FIG. 12 from the case shown in FIG. 5. This phenomenon is described in further detail with reference to FIG. 13.

Figure 13:
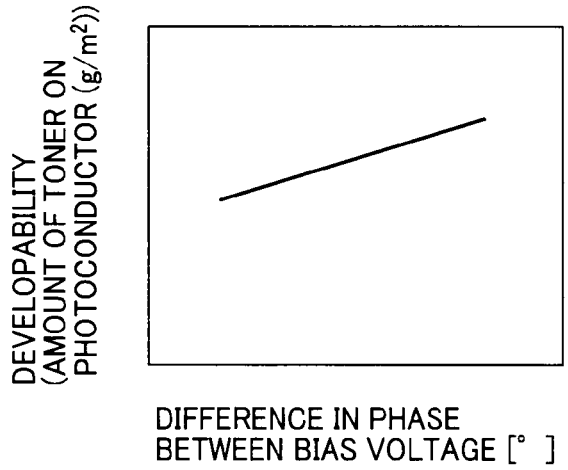
FIG. 13 is a graph illustrating the relation between developability and differences in phase between the inner and outer bias voltages applied to the inner and outer electrodes, respectively.

FIG. 13 is a graph that illustrates the relation between differences in phase of bias voltages and developability.

It can be also seen from the relation shown in FIG. 13 that, as the difference in phase between the bias voltages approaches π, the duration of time during which the developer hops increases, which facilitates formation of toner clouds and increases the degree of developability. Therefore, when the electrical field for flare is regulated by adjusting the difference in phase between the bias voltages, the state of developer that forms toner clouds, that is, the flare state, can be adjusted. Thus, the developability can be regulated.

Based on the relation shown in FIG. 13, for example, when the mean strength of the electrical field increases and accordingly the degree of developability is increased due to decreases in the thickness of the surface layer 6 of the development roller 103, the flare state can be restricted by adjusting the difference in phase between the bias voltages applied to the inner electrode 23*a* and the outer electrodes 24*a* in a direction for restricting the flare state. Consequently, the degree of developability can be regulated.

Figure 14:
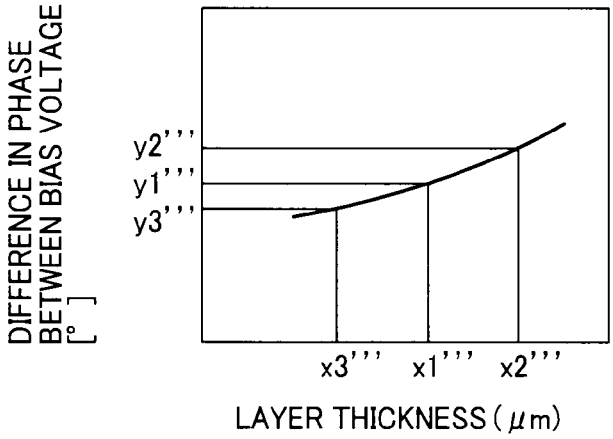
FIG. 14 is a graph that illustrates the relation between the thickness of the surface layer and differences in phase between the first and second bias voltages to maintain a constant, desired level of developability.

FIG. 14 is a graph that illustrates the relation between the thickness of the surface layer 6 and differences in phase between the bias voltages for maintaining a constant, desired level of developability.

As shown in FIG. 14, when the thickness of the surface layer 6 is x1'''', the difference in phase between the bias voltages for attaining the desired flare state is y1''''. Similarly, when the thickness of the surface layer 6 is x2''''' and x3''''', the difference in phase is y2''''' and y3''''', respectively. This relation can be expressed as formula 4 shown below.

$$Dp=f_E(t_X) \tag{4}$$

wherein Dp represents the difference in phase, and $t_x$ represents the thickness of the surface layer 6 of the development roller 103.

The relation shown in FIG. 14 and expressed as formula 4 can be experimentally obtained. More specifically, the thickness of the surface layer 6 is gradually reduced from the initial thickness, and the amount by which the difference in phase between the bias voltages should be adjusted (hereinafter "adjustment amount") for maintaining a constant flare state, that is, a constant level of developability, is determined for each thickness. By obtaining the relation shown in FIG. 14 and expressed as formula 4, the adjustment amount of the difference in phase between the bias voltages can be calculated when the thickness of the surface layer 6 is varied, and a suitable value of the difference in phase (development-related variable) for the current thickness of the surface layer 6 can be obtained. Accordingly, the flare state can be kept constant in accordance with changes in the thickness of the surface layer 6. For example, when the thickness of the surface layer 6 is reduced from the initial thickness of x1'''' to x3'''' over time, the strength of the electrical field for flare increases. At that time, a flare state similar to the initial state can be attained by reducing the difference in phase between the bias voltages to y3''''.

This adjustment is also effective to handle differences in the thickness of the surface layer 6 of the development roller 103 due to tolerance in manufacturing. For example, it is assumed that the thickness x1'''' is a standard thickness of the surface layer of development rollers and the difference in phase is y1'''' when the thickness is x1''''. In this case, if the thickness of the surface layer of a given development roller is x2''''', the desired flare state can be attained by setting the difference in phase between the bias voltages to y2''''' initially. Thus, deviations in the thickness of the surface layer unique to specific development rollers can be managed.

It is to be noted that, as described above, the surface layer 6 of the development roller 103 is in contact with the seal member 109 for electrical discharge in addition to the developer regulator 104 and the supply roller 105 and accordingly is abraded over time, and thus the thickness of the surface layer 6 fluctuates. This is similar in the above-described first through fourth embodiments. Therefore, it is preferable to provide a layer thickness estimation device for estimating changes in the thickness of the surface layer 6 over time and to operate the electrical field adjuster 130, 130A, 130B, or 130C (hereinafter collectively "electrical field adjuster 130") automatically according to the value estimated (i.e., an estimated wear amount and an estimated layer thickness) by the layer thickness estimation device.

Changes, in particular, decreases, in the thickness of the surface layer 6 from the initial thickness is mainly caused by wear due to the contact between the development roller 103 and the developer regulator 104, the supply roller 105, and the seal member 109. Therefore, the amount of wear, that is, the amount by which the surface layer 6 is abraded, closely correlates with the number of times the development roller 103 has rotated (hereinafter "cumulative rotational number N").

Figure 15:
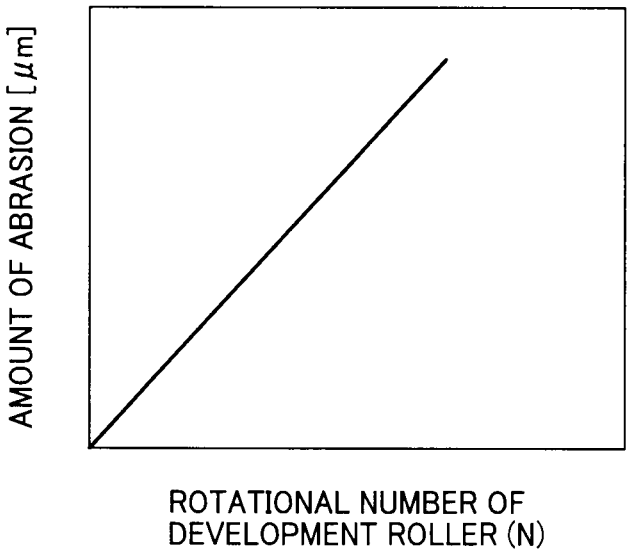
FIG. 15 is a graph illustrating the relation between the amount of abrasion (wear amount) of the surface layer of the development roller and the number of times the development roller has rotated.

FIG. 15 illustrates the relation between the wear amount (i.e., abrasion amount) and the cumulative rotational number N of the development roller 103.

As can be seen from FIG. 15, basically, the wear amount and the cumulative rotational number N of the development roller 103 are proportional to each other. Therefore, as the layer thickness estimation device, the first rotational number detector 131 shown in FIG. 3 can be employed to count or detect the cumulative rotational number N of the development roller 103. From the relation between the wear amount of the cumulative rotational number N of the development roller 103, such as the one shown in FIG. 15, obtained experimentally, the following formulas 5 and 6 can be obtained.

$$w_1=a\times N \tag{5}$$

wherein $w_1$ represents the estimated wear amount of the surface layer 6, a represents a coefficient, and N represents the number of times the development roller 103 has rotated.

$$t_x=t_0-w_1 \tag{6}$$

wherein $t_x$ represents a current thickness of the surface layer 6, and $t_0$ represents the initial thickness of the surface layer 6.

The estimated wear amount $w_1$ can be calculated based on the cumulative rotational number N detected by the first rotational number detector 131 using the formula 5, and the current thickness $t_x$ of the surface layer 6 can be calculated using the formula 6. Additionally, the electrical field adjuster 130 can be operated automatically by assigning the current thickness thus estimated to the $t_x$ in one of the above-described formulas 1 through 4 so as to control the development device 4 to maintain a constant flare state automatically.

Further, the cumulative rotational number N of the development roller 103 closely correlates with the cumulative rotational number of the photoconductor drum 2. More specifically, the development roller 103 rotates in synchronization with the photoconductor drum 2, and thus the cumulative rotational number N of the development roller 103 can be calculated using the cumulative rotational number or cumulative travel distance of the photoconductor drum 2. In other words, because the difference between the linear velocity of the photoconductor drum 2 and that of the development roller 103 is known, the cumulative rotational number or cumulative travel distance of the development roller 103 can be calculated using the cumulative rotational number or cumulative travel distance of the photoconductor drum 2. Therefore, as the layer thickness estimation device, the second rotational number detector 131A that detects or counts the number of times the photoconductor drum 2 (i.e., latent image carrier) has rotated can be employed instead of the first rotational number detector 131. In this case, the following formulas 7 and 8 obtained experimentally can be used.

$$w_1'=a'\times N' \tag{7}$$

wherein $w_1'$ represents the wear amount of the development roller 103, a' represents a coefficient, and N' represent the number of times the photoconductor drum 2 has rotated.

$$t_x'=t_0'-w_1' \quad (8)$$

wherein $t_x'$ represents the thickness of the surface layer 6 and $t_0'$ represents the initial thickness of the surface layer 6.

When the image forming apparatus already includes a travel distance detector or the like for determining the expiration of operational life of the photoconductor drum 2, such a detector can be used also as the second rotational number detector 131A that counts the number of times the photoconductor drum 2 has rotated. Using such an existing detector also as the layer thickness estimation device is preferable because neither the cost nor the number of components increases in that case.

Next, an algorithm of automatic control using the electrical field adjuster 130 in which the layer thickness estimation device is employed is described below.

Figure 16:
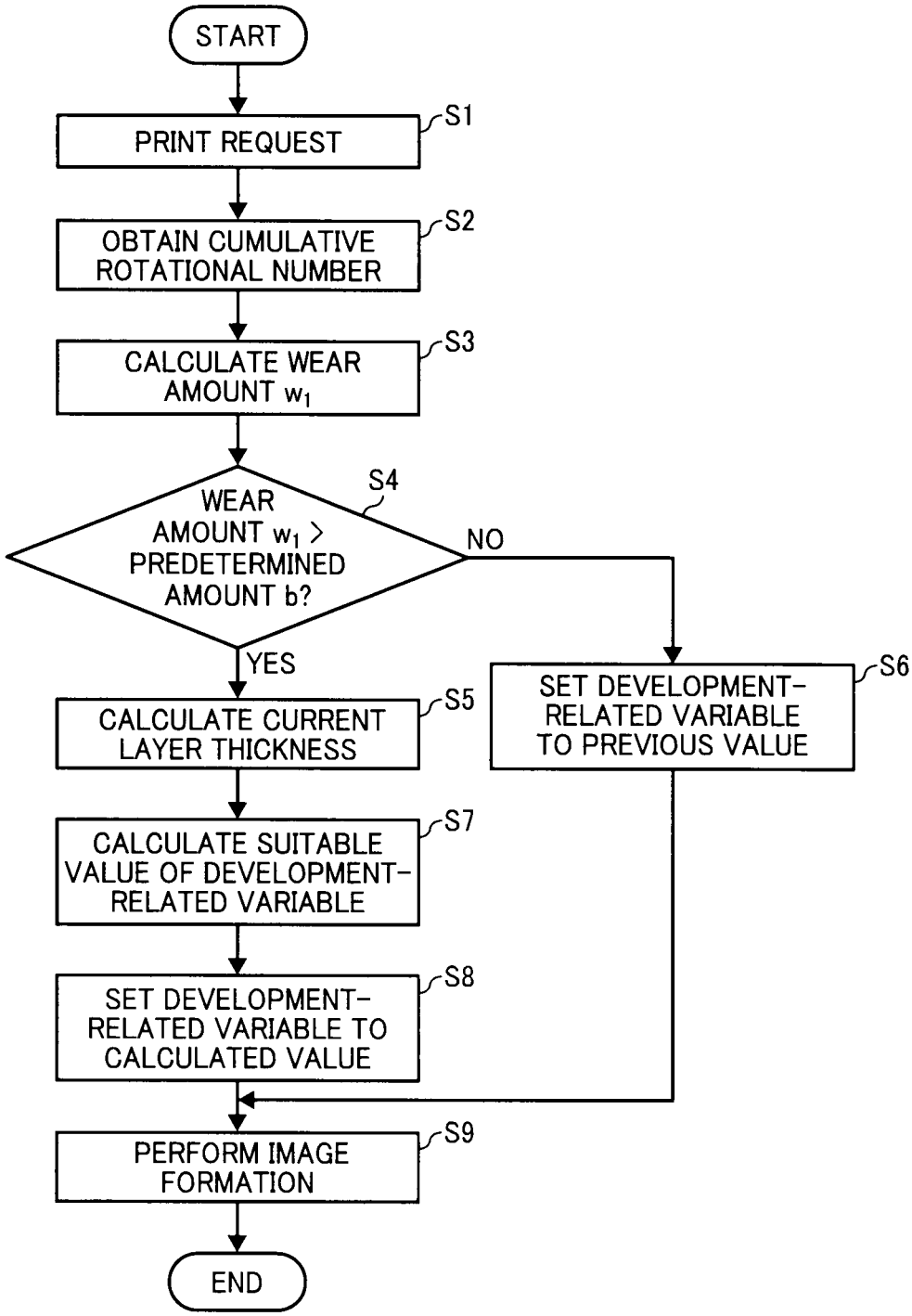
FIG. 16 illustrates an algorithm of automatic control of an electrical field adjuster in which a layer thickness estimation device is used.

Referring to FIG. 16, at S1, the algorithm is started with the receipt of a printing request. The printing request is input to a controller 136 (shown in FIG. 3) of the image forming apparatus 100. The controller is comprised of a CPU and associated memory units and operatively connected to the electrical field adjuster 130, the rotational number detector 131 or 131A, and the environmental condition detector 132. At S2, the controller 136 retrieves the cumulative rotational number N of the development roller 103 counted by the first rotational number detector 131 or the cumulative rotational number N' of the photoconductor drum 2 counted by the second rotational number detector 131A. At S3, the wear amount $w_1$ is calculated by assigning the retrieved cumulative rotational number N or N' to the formula 5 or 7. At S4, the controller 136 checks whether the calculated wear amount $w_1$ is equal to or greater than a predetermined value b preliminarily input to the controller 136.

When the calculated wear amount $w_1$ is less than the predetermined value b (NO at S4), image formation is performed with the previously set development-related variable, which is the peak-to-peak voltage Vpp of the bias voltages in the first embodiment, the rise time ms of the bias voltages in the second embodiment, the frequency of the bias voltages in the third embodiment, and the difference in phase between the bias voltages in the fourth embodiment.

By contrast, when the calculated wear amount $w_1$ is greater than the predetermined value b (YES at S4), at S5, the controller 136 calculates the current thickness of the surface layer $t_x$ by deducting the wear amount $w_1$ from the initial thickness $t_0$. Further, at S7, a suitable value of the development-related variable for the current thickness of the surface layer 6 is calculated. More specifically, the suitable peak-to-peak voltage Vpp is calculated using the formula 1 based on the relation shown in FIG. 7, the suitable rise time ms of the bias voltages is calculated using the formula 2 based on the relation shown in FIG. 9, the suitable frequency of the bias voltages is calculated using the formula 3 based on the relation shown in FIG. 11, or the difference in phase between the bias voltages is calculated using the formula 4 based on the relation shown in FIG. 14. At S 8, the development-related variable (peak-to-peak voltage Vpp, the rise time ms, the frequency, or the difference in phase between the bias voltages) is set to the suitable value thus calculated. At S9, image formation is performed with the development-related variable thus adjusted.

It is to be noted that, in the above-described embodiments, the cumulative rotational number N of the development roller 103 counted by the first rotational number detector 131 or the cumulative rotational number N' of the photoconductor drum 2 counted by the second rotational number detector 131A can be reset when the development device 4 is removed from the image forming apparatus 100, in particular, when the development device 4 incorporated in the process cartridge 1 is removed from the image forming apparatus 100 together with the process cartridge 1. The development device 4 or the process cartridge 1 is typically replaced periodically in maintenance work, and the cumulative rotational number N or N' should be reset, that is, set to zero, when a new development device 4 or a new process cartridge 1 is installed in the image forming apparatus 100.

Alternatively, the image forming apparatus 100 can be configured so that users can select whether to reset the cumulative rotational number N or N' when the development device 4 or process cartridge 1 is removed and then the used one or new one is installed in the image forming apparatus 100. In this case, for example, an operation panel, not shown, of the image forming apparatus 100 may display such a message for the user. With this configuration, the counted cumulative rotational number N or N' can be maintained when the used process cartridge 1 is again installed in the image forming apparatus 100, which is convenient for the user.

Herein, it is known to those skilled in the art that it is possible that material properties, for example, hardness, of the surface layer 6, the supply roller 105, and the like change depending on installation site conditions (environmental conditions), such as a low-temperature and low-humidity condition or a high-temperature and high-humidity condition, to which the image forming apparatus 100 and the development device 4 included therein are subjected. If the material properties, such as hardness, of the surface layer 6 or the supply roller 105 in direct contact with the surface layer 6 change, the wear amount by which the surface layer 6 is abraded can change accordingly.

Figure 17:
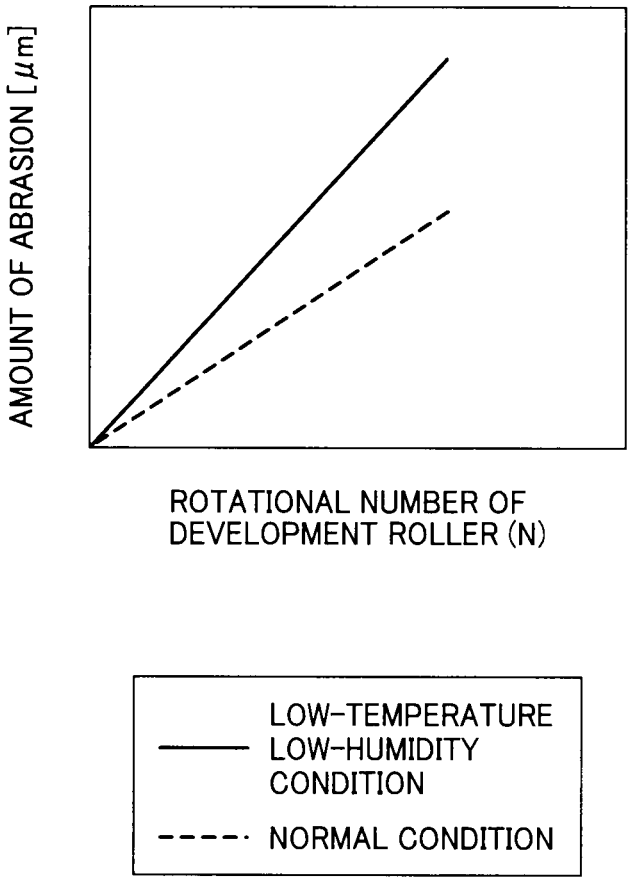
FIG. 17 is a graph illustrating results of an experiment to evaluate changes in the wear amount of the surface layer of the development roller due to changes in installation site conditions.

FIG. 17 is a graph illustrating results of an experiment to evaluate changes in the wear amount of the surface layer 6 due to changes in the installation site conditions.

In FIG. 17, broken lines represent the relation between the wear amount and the cumulative rotational number of the development roller 103 in a normal environmental condition with ordinary temperature and humidity, and a solid line represents that in the low-temperature and low-humidity condition. As can be seen from FIG. 17, the wear amount of an identical development roller 103 is greater in the low-temperature and low-humidity condition than the normal environmental condition. It is presumed that the results shown in FIG. 17 are obtained because the surface layer 6 and materials in contact with the surface layer 6 become harder in the low-humidity condition. Therefore, it is preferable to correct the estimated wear amount $w_1$ estimated by the layer thickness estimation device, for example, the first rotational number detector 131, depending on the installation site conditions.

Therefore, in the present embodiment, the environmental condition detector 132 (shown in FIG. 3) is provided so as to correct the estimated wear amount $w_1$. For example, the environmental condition detector 132 can be a temperature and humidity sensor or a thermo-hygrometer capable of outputting measurement results as measurement values. A correction value by which the estimated wear amount $w_1$ is adjusted according to the environmental measurement value generated by the environmental condition detector 132 can be obtained experimentally. For example, a relation such as one shown in FIG. 17 can be obtained by measuring the wear amount in each of various installation site conditions in an experiment, and multiple correction values or correction coefficients β for the respective installation site conditions are determined by comparing the wear amount in each installation site condition with that in the normal environmental condition using the relation such as one shown in FIG. 17.

More specifically, a more suitable wear amount (i.e., a corrected wear amount) $w_2$, can be calculated by multiplying the estimated wear amount $w_1$ by the correction coefficient β. Then, a more suitable thickness (current thickness) $t_x$ of the surface layer 6 can be calculated using the corrected wear amount $w_2$. This relation can be expressed as the following formulas 9 and 10 using the formula 5 ($w_1$=a×N).

$$w_2=\beta\times w_1 \tag{9}$$

wherein $w_2$ represents the corrected wear amount, β represents the correction coefficient, and $w_1$ represents the estimated wear amount of the surface layer 6 calculated by the layer thickness estimation device (131 or 131A).

$$t_x=t_0-w_1 \tag{10}$$

wherein $t_x$ and $t_0$ represent the current and initial thickness of the surface layer 6, respectively.

Figure 18:
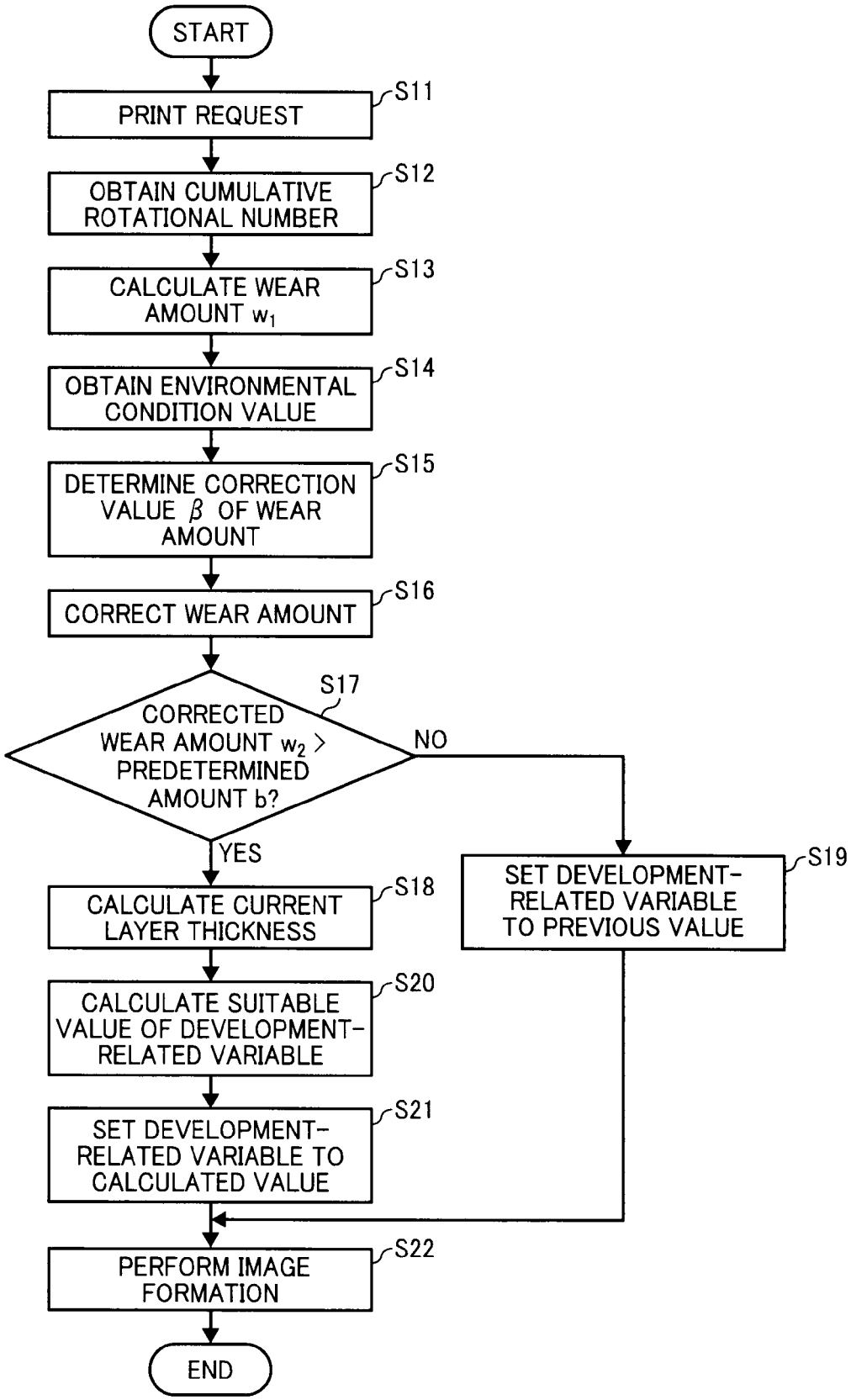
FIG. 18 illustrates an algorithm of automatic control of the electrical field adjuster in which an estimated wear amount of the surface layer is corrected with a correction coefficient $\beta$ based on measurement of the installation site conditions.

FIG. 18 illustrates an algorithm of automatic control using the electrical field adjuster 130 in which estimated wear amount $w_1$ of the surface layer 6 is corrected with the correction coefficient β based on measurement of the environmental value.

Also in the algorithm shown in FIG. 18, after a printing request is received at S11, at S12, the controller 136 retrieves the cumulative rotational number N of the development roller 103 counted by the first rotational number detector 131 or the cumulative rotational number N' of the photoconductor drum 2 counted by the second rotational number detector 131A. Then, at S13, the wear amount $w_1$ is calculated using the retrieved cumulative rotational number N or N'.

Further, at S14, the environmental condition detector 132 generates an environmental measurement value based on the environmental conditions around the development device 4 or the image forming apparatus 100 and transmits the environmental measurement value to the controller 136. At S15, based on the environmental measurement value, one of the multiple predetermined correction coefficients β is selected. At S16, the corrected wear amount $w_2$ is calculated by multiplying the wear amount $w_1$ by the correction coefficient β.

It is to be noted that the correction coefficient 0 equals 1 when the installation site condition is determined as the normal environmental condition based on the environmental measurement value. At S17, the controller 136 determines whether or not the corrected wear amount $w_2$ is equal to or greater than the predetermined value b.

Subsequently, in the algorithm shown in FIG. 18, processes similar to those shown in FIG. 16 are performed. More specifically, when the corrected wear amount $w_2$ is less than the predetermined value b (NO at S17), at S19, the development-related variable is set to the previously set value, and image formation is performed at S22. By contrast, when the corrected wear amount $w_2$ is not less than the predetermined value b (YES at S17), at S18, the controller 136 calculates the current thickness $t_x$ of the surface layer by deducting the corrected wear amount $w_2$ from the initial thickness $t_0$. Further, at S20, a suitable value of the development-related variable for the current thickness of the surface layer 6 is calculated. More specifically, the suitable peak-to-peak voltage Vpp is calculated using the formula 1 based on the relation shown in FIG. 7, the suitable rise time ms of the bias voltages is calculated using the formula 2 based on the relation shown in FIG. 9, the suitable frequency of the bias voltages is calculated using the formula 3 based on the relation shown in FIG. 11, or the difference in phase between the bias voltages is calculated using the formula 4 based on the relation shown in FIG. 14. At S 21, using the electrical field adjuster 130, the development-related variable (peak-to-peak voltage Vpp, the rise time ms, the frequency, or the difference in phase of the bias voltages) is set to the suitable value. At S22, image formation is performed with the development-related variable thus adjusted.

Herein, it is known that the electrical charge amount of developer changes as the environmental conditions around the development device 4 change. For example, the electrical charge amount of developer is greater in the low-temperature and low-humidity condition than the normal environmental condition. By contrast, the electrical charge amount of developer is smaller in the high-temperature and high-humidity condition than the normal environmental condition. When the charge mount of the developer changes, the force of electrostatic adhesion of developer to the development roller 103 changes accordingly. Therefore, for example, if the electrical field is set so that the developer can hop properly in the low-temperature and low-humidity condition, the developer hops excessively when the development device 4 is operated in the high-temperature and high-humidity condition. In such a case, it is possible that the developer hopping due to the effects of such an electrical field fails to return to the development roller 103. Consequently, the developer scatters inside the image forming apparatus 100.

In view of the foregoing, it is preferable that the electrical field adjuster 130 should adjust the flare state of toner also according to changes in the charge amount of toner caused by changes in the environmental conditions.

Figure 19:
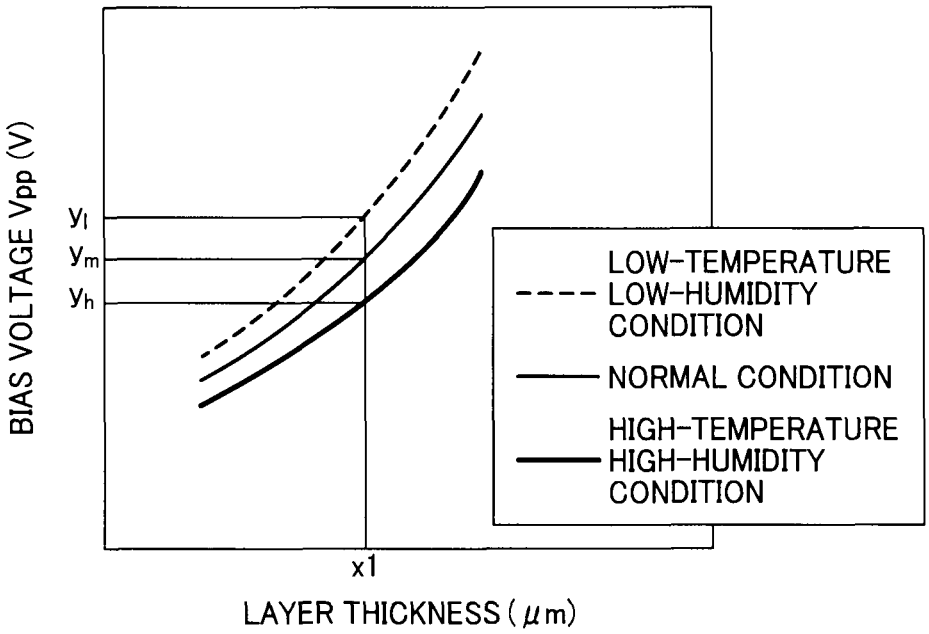
FIG. 19 is a graph that illustrates the relation between the peak-to-peak voltage of the bias voltages for attaining a suitable flare state and the thickness of the surface layer in each of three different installation site conditions.
Figure 20:
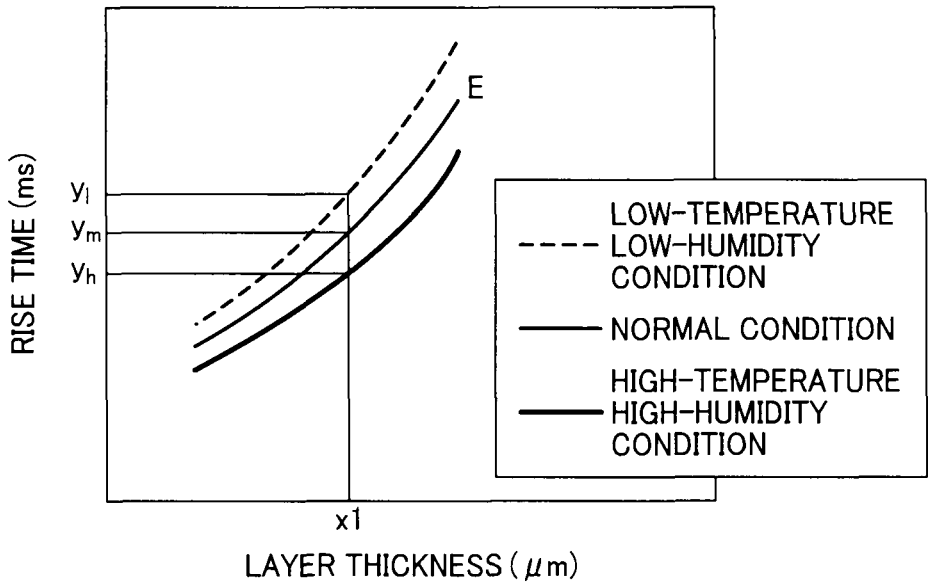
FIG. 20 is a graph that illustrates the relation between the rise time of the bias voltages for attaining a suitable flare state and the thickness of the surface layer in each of three different installation site conditions.
Figure 21:
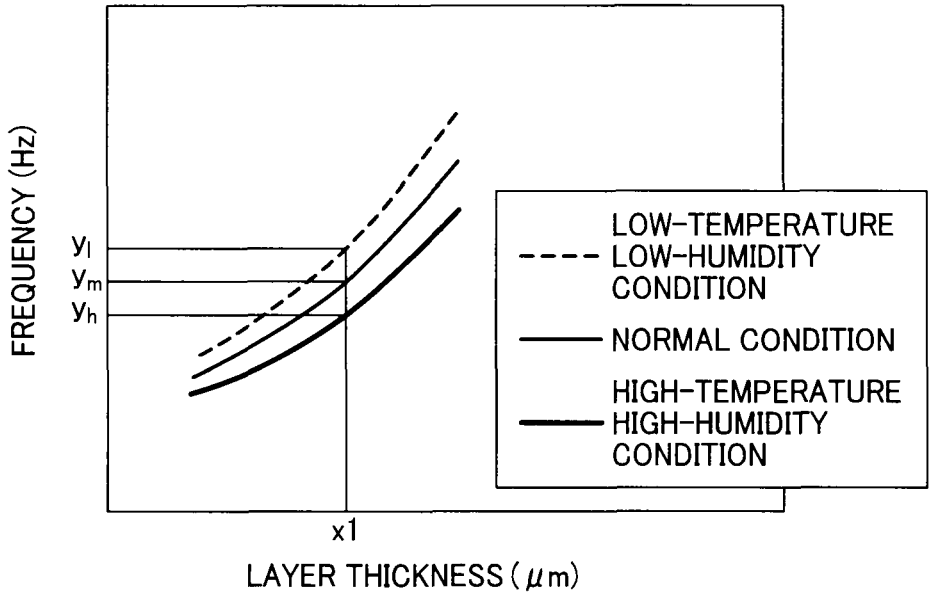
FIG. 21 is a graph that illustrates the relation between the frequency of the bias voltages for attaining a suitable flare state and the thickness of the surface layer in each of three different installation site conditions.
Figure 22:
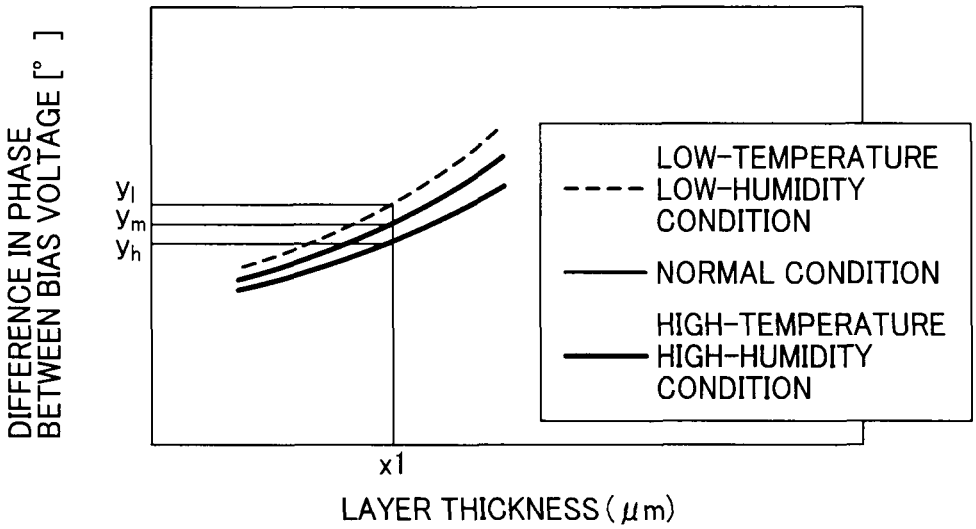
FIG. 22 is a graph that illustrates the relation between differences in phase between the bias voltages for attaining a suitable flare state and the thickness of the surface layer in each of three different installation site conditions.

FIGS. 19 through 22 illustrate the suitable development-related variables for an identical thickness of the surface layer 6 when installation site conditions are changed. More specifically, FIG. 19 is a graph that illustrates the relation between the thickness of the surface layer 6 and the peak-to-peak voltage Vpp of the bias voltages for attaining a suitable flare state in each of three different installation site conditions. FIG. 20 is a graph that illustrates the relation between the thickness of the surface layer 6 and the rise time of the bias voltages for attaining a suitable flare state and suitable level of developability in each of three different installation site conditions. Further, FIGS. 21 and 22 are graphs that illustrate the relations between the thickness of the surface layer 6 and the frequency of and the differences in phase between the bias voltages for attaining a suitable flare state in each of three different installation site conditions. In each of FIGS. 19 through 22, a bold line represents the relation between the development-related variable and the layer thickness in the high-temperature and high-humidity condition, a solid line represents that in the normal environmental condition, and broken lines represent that in the low-temperature and low-humidity condition.

For example, in FIG. 22, if the current thickness is $x_1$ and the difference in phase between the bias voltages for attaining a suitable flare state in the normal environmental condition is $y_m$, the difference in phase is changed to $y_h$ in the high-temperature and high-humidity condition. By contrast, the difference in phase is changed to $y_1$ in the low-temperature and low-humidity condition.

It is to be noted that the relation between the surface thickness and the suitable value of the development-related variable for attaining the suitable flare state in accordance with the installation site conditions shown in FIGS. 19 through 22 can be obtained experimentally. More specifically, while keeping the thickness of the surface layer 6 constant, the charge amount of developer is changed by varying the installation site conditions. Then, the development-related variable suitable for attaining a predetermined flare state is measured for each charge amount of developer.

Figure 23A:
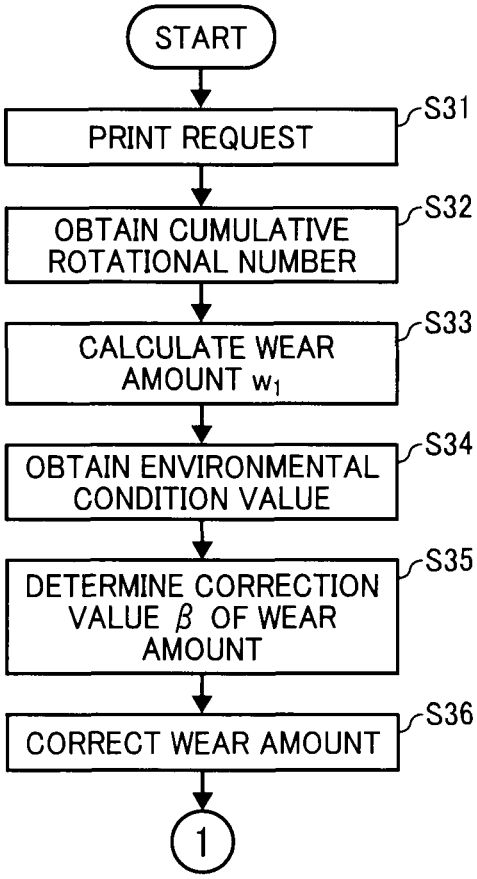
FIG. 23 illustrates an algorithm of automatic control using the electrical field adjuster in which the charge amount of developer, which changes as the installation site conditions change, is also taken into consideration based on measurement of the installation site conditions.
Figure 23B:
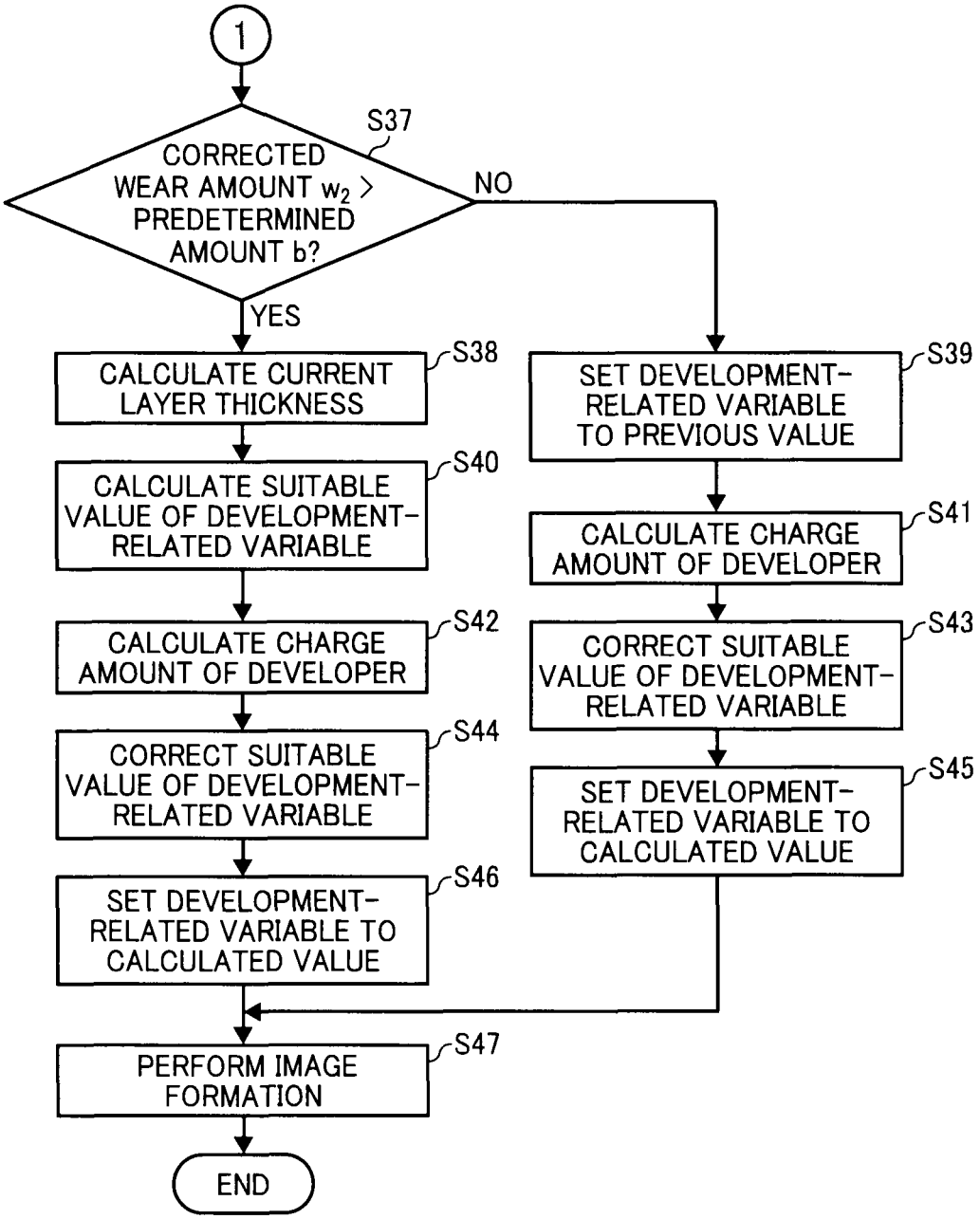

FIG. 23 illustrates an algorithm of automatic control using the electrical field adjuster 130 in which the charge amount of developer, which changes as the installation site condition of the development device 4 changes, is also taken into consideration based on measurement of the environmental value.

In the algorithm shown in FIG. 23, from S31 at which algorithm is started with the receipt of a print request until S37 at which whether or not the corrected wear amount $w_2$ is equal to or greater than the predetermined value b is determined, processes are similar to steps S11 through S17 shown in FIG. 18. Further, similarly to steps S18 through S20 shown in FIG. 18, at S39 the development-related variable is set to the previous value when the corrected wear amount $w_2$ is less than the predetermined value b, and, when the corrected wear amount $w_2$ is not less than the predetermined value b, at S38 and S40, the controller 136 calculates the current thickness $t_x$ of the surface layer and then calculates the development-related variable suitable for the current thickness $t_x$.

Further, in the algorithm shown in FIG. 23, regardless of whether the corrected wear amount $w_2$ is greater than the predetermined value b, at S41 or S42, the controller 136 determines changes in the charge amount of the developer based on the environmental measurement value generated by the environmental condition detector 132. At S43 or S44, the suitable value of the development-related variable is corrected using a charge amount correction coefficient γ obtained from the relation shown in FIGS. 19 through 22, and at S45 or S46 the development-related variable is set to the suitable value thus calculated. Correction of the development-related variable using the charge amount correction coefficient γ can be expressed as the following formula 11.

$$f_E=(t_x,\gamma) \tag{11}$$

wherein $f_E$ represents the development-related variable, namely, the peak-to-peak value Vpp of the bias voltages, the rise time thereof, the frequency thereof, or the difference in phase therebetween.

Thus, the flare state can be better regulated with consideration of changes in the charge amount of developer in addition to changes in the layer thickness caused by changes in the installation site conditions. Then, at S47 image formation is performed with the development-related variable thus corrected.

It is to be noted that, although the descriptions above concern the control that involves both correction of estimated wear amount by the layer thickness estimation device (131 or 131A) using the environmental condition detector 132 and correction of the development-related variable based on changes in the charge amount of developer, various combination can be available. For example, while the environmental condition detector 132 is provided, the layer thickness estimation device (131 or 131A) may be omitted. In this case, the flare state regulated by the electrical field adjuster 130 is further adjusted in view of the environmental measurement value although the environmental measurement value is not used to correct the estimated layer thickness by the layer thickness estimation device.

As described above, in the above-described embodiments, the electrical field adjuster adjusts the electrical fields generated between the outer electrodes of the development roller in accordance with changes in the thickness of the surface layer of the development roller so as to keep the flare state of developer constant. Therefore, image the developability can be kept constant even when the development roller is abraded over time. Additionally, manufacturing tolerances can be handled by measuring the thickness of the surface layer of development roller and by setting the development related variable in accordance with the measured thickness. Consequently, image density of output images can be kept constant.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device for causing a developer to adhere to an electrostatic latent image formed on a latent image carrier, the development device comprising:

a developer container for containing the developer;

a rotary cylindrical developer carrier disposed in the developer container, facing the latent image carrier;

the developer carrier including multiple outer electrodes arranged in a circumferential direction of the developer carrier, an inner electrode provided on an inner circumferential side of the developer carrier from the multiple outer electrodes and electrically insulated from the multiple outer electrodes, an insulation layer disposed between the multiple outer electrodes and the inner electrode, and a surface layer overlaying an outer side of each of the multiple outer electrodes and electrically insulating the multiple outer electrodes from each other;

a bias power source to generate electrical fields on a circumferential surface of the developer carrier, the electrical fields changing with time and causing the developer to hop on the developer carrier, by applying a first bias voltage and a second bias voltage to the inner electrode and the multiple outer electrodes, respectively;

an electrical field adjuster to keep a state of the developer hopping on the developer carrier constant by regulating the electrical fields in accordance with a thickness of the surface layer of the developer carrier; and a controller operatively connected to the electrical field adjuster for controlling the electrical field adjuster.

2. The development device according to claim 1, wherein the electrical field adjuster comprises a voltage adjuster for adjusting a peak-to-peak voltage of each of the first bias voltage and the second bias voltage applied to the inner electrode and the multiple outer electrodes, respectively.

3. The development device according to claim 1, wherein the electrical field adjuster comprises a rise time adjuster for adjusting a rise time of each of the first bias voltage and the second bias voltage applied to the inner electrode and the multiple outer electrodes, respectively.

4. The development device according to claim 1, wherein the electrical field adjuster comprises a frequency adjuster for adjusting a frequency of each of the first bias voltage and the second bias voltage applied to the inner electrode and the multiple outer electrodes, respectively.

5. The development device according to claim 1, wherein the electrical field adjuster comprises a phase adjuster for adjusting a difference in phase between the first bias voltage and the second bias voltage applied to the inner electrode and the multiple outer electrodes, respectively.

6. The development device according to claim 1, further comprising a layer thickness estimation device for generating an estimated thickness of the surface layer of the developer carrier by estimating a change in the thickness of the surface layer of the developer carrier, wherein the electrical field adjuster regulates the electrical field in accordance with the estimated thickness of the surface layer of the developer carrier.

7. The development device according to claim 6, wherein the layer thickness estimation device comprises a first rotational number detector that detects a number of times the developer carrier has rotated.

8. The development device according to claim 6, wherein the layer thickness estimation device comprises a second rotational number detector that detects a number of times the latent image carrier has rotated.

9. The development device according to claim 6, further comprising an environmental condition detector for detecting an environmental condition around the development device and generating an environmental condition value, wherein the estimated thickness of the surface layer of the developer carrier estimated by the layer thickness estimation device is adjusted according to the environmental condition value generated by the environmental condition detector.

10. The development device according to claim 1, further comprising an environmental condition detector for detecting an environmental condition around the development device and generating an environmental condition value, wherein the controller calculates a change in an electrical charge amount of the developer in the developer container based on the environmental condition value, and the electrical field adjuster regulates the electrical field in accordance with the change in the electrical charge amount of the developer.

11. A process cartridge removably installable in an image forming apparatus, comprising the development device according to claim 1, wherein the development device and at least one of a latent image carrier, a charge device, and a cleaning device are housed in a common casing.

12. An image forming apparatus comprising:

a latent image carrier on which a latent image is formed; and a development device for causing a developer to adhere to the electrostatic latent image formed on the latent image carrier, the development device comprising:

a developer container for containing the developer;

a rotary cylindrical developer carrier disposed in the developer container, facing the latent image carrier;

the developer carrier including multiple outer electrodes arranged in a circumferential direction of the developer carrier, an inner electrode provided on an inner circumferential side of the developer carrier from the multiple outer electrodes and electrically insulated from the multiple outer electrodes, an insulation layer disposed between the multiple outer electrodes and the inner electrode, and a surface layer overlaying an outer side of each of the multiple outer electrodes and electrically insulating the multiple outer electrodes from each other;

a bias power source to generate electrical fields on a circumferential surface of the developer carrier, the electrical fields changing with time and causing the developer to hop on the developer carrier, by applying a first bias voltage and a second bias voltage to the inner electrode and the multiple outer electrodes, respectively;

an electrical field adjuster to keep a state of the developer hopping on the developer carrier constant by regulating the electrical fields in accordance with a thickness of the surface layer of the developer carrier; and a controller operatively connected to the electrical field adjuster for controlling the electrical field adjuster.

13. The image forming apparatus according to claim 12, wherein the electrical field adjuster comprises a voltage adjuster for adjusting a peak-to-peak voltage of each of the first bias voltage and the second bias voltage applied to the inner electrode and the multiple outer electrodes, respectively.

14. The image forming apparatus according to claim 12, wherein the electrical field adjuster comprises a rise time adjuster for adjusting a rise time of each of the first bias voltage and the second bias voltage applied to the inner electrode and the multiple outer electrodes, respectively.

15. The image forming apparatus according to claim 12, wherein the electrical field adjuster comprises a frequency adjuster for adjusting a frequency of each of the first bias voltage and the second bias voltage applied to the inner electrode and the multiple outer electrodes, respectively.

16. The image forming apparatus according to claim 12, wherein the electrical field adjuster comprises a phase adjuster for adjusting a difference in phase between the first bias voltage and the second bias voltage applied to the inner electrode and the multiple outer electrodes, respectively.

17. The image forming apparatus according to claim 12, further comprising a layer thickness estimation device for generating an estimated thickness of the surface layer of the developer carrier by estimating a change in the thickness of the surface layer of the developer carrier, wherein the electrical field adjuster regulates the electrical field in accordance with the estimated thickness of the surface layer of the developer carrier.

18. The image forming apparatus according to claim 17, further comprising an environmental condition detector for detecting an environmental condition around the development device and generating an environmental condition value, wherein the estimated thickness of the surface layer of the developer carrier estimated by the layer thickness estimation device is adjusted according to the environmental condition value generated by the environmental condition detector.

19. A development device comprising:

a developer carrier that carries developer to develop an electrostatic latent image formed on a latent image carrier, the developer carrier disposed facing the latent image carrier and including:

multiple different types of electrodes, an insulation layer disposed between the multiple different types of electrodes, and a surface layer that gives a desired electrical charge to developer, the surface layer being disposed on an outer circumferential side of the multiple different types of electrodes in the radial direction of the developer carrier;

an electrical field generator that generates an electrical field to transport the developer carried on an outer circumferential surface of the developer carrier to a development area by applying a bias voltage to between the multiple different types of electrodes, the electrical field causing the developer to hop on the developer carrier; and an electrical field adjuster that regulates the electrical field in accordance with a thickness of the surface layer of the developer carrier.

20. The development device according to claim 19, further comprising a layer thickness estimation device that generates an estimated thickness of the surface layer of the developer carrier by estimating a change in the thickness of the surface layer of the developer carrier, wherein the electrical field adjuster regulates the electrical field in accordance with the estimated thickness of the surface layer of the developer carrier.

21. The development device according to claim 19, wherein the multiple different types of electrodes comprise a first type of electrode and a second type of electrode, and the electrical field generator alternately applies the bias voltage to the first type of electrode and the second type of electrode to cause the developer to hop on the developer carrier.

* * * * *